US011402079B1

(12) United States Patent
Bucher et al.

(10) Patent No.: US 11,402,079 B1
(45) Date of Patent: Aug. 2, 2022

(54) LANDSCAPE LAMPS WITH ADJUSTABLE LIGHT MODIFIERS

(71) Applicant: CHIEN LUEN INDUSTRIES CO., LTD., INC., Oakland Park, FL (US)

(72) Inventors: Charles E. Bucher, Tampa, FL (US); Zachary Zauhar, Fort Lauderdale, FL (US); Mark Starling, Ft. Lauderdale, FL (US); Tim Bowling, Marietta, GA (US)

(73) Assignee: Chien Luen Industries Co., Ltd., Inc., Oakland Park, FL (US)

( * ) Notice: Subject to any disclaimer, the term of this patent is extended or adjusted under 35 U.S.C. 154(b) by 0 days.

(21) Appl. No.: 17/083,626

(22) Filed: Oct. 29, 2020

(51) Int. Cl.

| | |
|---|---|
| ***F21S 8/08*** | (2006.01) |
| ***F21V 14/04*** | (2006.01) |
| ***F21V 7/00*** | (2006.01) |
| ***F21V 21/08*** | (2006.01) |
| *F21Y 115/10* | (2016.01) |

(52) U.S. Cl.
CPC ..... *F21V 14/04* (2013.01); *F21V 7/0008* (2013.01); *F21V 21/0824* (2013.01); *F21Y 2115/10* (2016.08)

(58) Field of Classification Search
CPC .... F21V 14/04; F21V 7/0016; F21V 21/0824; F21V 21/22; F21V 21/12; F21W 2111/023; F21W 2131/109; F21S 8/08
See application file for complete search history.

(56) References Cited

U.S. PATENT DOCUMENTS

| | | | | | |
|---|---|---|---|---|---|
| 260,933 | A | | 7/1882 | Brassill | |
| 1,613,382 | A | * | 1/1927 | Clarke | F21V 21/06 211/196 |
| 3,015,720 | A | * | 1/1962 | Silverman | F21S 8/088 362/431 |
| 3,725,696 | A | * | 4/1973 | Morton | F21V 21/22 362/399 |
| 3,995,796 | A | * | 12/1976 | Kline | A47K 1/08 248/156 |
| 4,774,648 | A | * | 9/1988 | Kakuk | F21V 21/0824 362/302 |
| 5,055,987 | A | * | 10/1991 | Ellson | F21V 14/04 362/322 |
| 5,086,379 | A | * | 2/1992 | Denison | F21S 8/081 248/289.11 |

(Continued)

*Primary Examiner* — Ismael Negron
(74) *Attorney, Agent, or Firm* — Brian S. Steinberger; Hilary F. Steinberger; Law Offices of Brian S. Steinberger, P.A.

(57) ABSTRACT

The pathway/landscape lamps include an elongated fixture body having an upper end and a lower end; at least one light source mounted to the upper end of the fixture body; a ground engaging post provided at the lower end of the fixture body; and a telescoping shade with a reflective top cover provided over the light source and translucent sides at least partially surrounding the light source. The telescoping shade configured to move from a lowered position allowing light from the light source to be directed downward, to a raised position allowing for light to be emitted both sideways and downward from the light source. A second embodiment of the telescoping shade include at least one vertically adjustable side shade configured to selectively block light to be emitted in a sideway direction.

17 Claims, 18 Drawing Sheets

(56) References Cited

U.S. PATENT DOCUMENTS 5,178,452 A * 1/1993 Scholz ..... F21V 14/04 362/304
5,564,822 A * 10/1996 Golden ..... F21V 21/0824 362/450
5,582,479 A * 12/1996 Thomas ..... F21V 14/04 362/277
5,758,949 A 6/1998 Van Deursen
5,927,847 A * 7/1999 Cales ..... F21L 19/00 362/477
6,068,388 A * 5/2000 Walker ..... F21V 14/04 362/263
6,135,611 A * 10/2000 Maglica ..... F21L 4/005 362/294
6,183,112 B1 * 2/2001 Bomas ..... F21V 17/02 362/306
6,305,820 B1 10/2001 Poon
6,402,337 B1 * 6/2002 LeVasseur ..... F21V 21/06 362/153.1
6,776,508 B2 8/2004 Bucher et al.
D500,161 S 12/2004 Bucher et al.
6,874,905 B1 * 4/2005 Beadle ..... F21V 21/0824 362/372
7,021,788 B2 4/2006 Poon
7,207,697 B2 * 4/2007 Shoji ..... F21V 14/04 362/319
8,292,452 B2 * 10/2012 Ko ..... F21V 23/0442 362/183
8,602,585 B1 12/2013 Lowe et al.
8,632,234 B1 1/2014 Lowe et al.
8,840,273 B2 * 9/2014 Sooferian ..... F21V 14/04 362/280
9,279,554 B1 * 3/2016 Wierzbinski ..... F21V 21/06
9,822,952 B2 * 11/2017 Farmer ..... F21V 31/005
9,845,928 B1 * 12/2017 Tyson ..... F21V 29/83
9,863,629 B2 * 1/2018 Doyle ..... F21V 23/006
9,927,077 B1 * 3/2018 Fowkes ..... H01M 12/06
9,964,286 B1 * 5/2018 Sooferian ..... F21V 14/06
10,036,535 B2 * 7/2018 Catalano ..... F21V 14/04
10,145,555 B2 * 12/2018 Ohai ..... F21V 31/005
10,323,829 B1 6/2019 Zauhar et al.
11,054,124 B2 * 7/2021 Sharrah ..... H01R 33/90
2003/0201874 A1 * 10/2003 Wu ..... F21V 21/0824 340/573.2
2004/0012955 A1 * 1/2004 Hsieh ..... F21L 4/027 362/208
2004/0090782 A1 5/2004 Barozzini et al.
2005/0117338 A1 6/2005 Kratz
2006/0034072 A1 * 2/2006 Shih ..... F21L 4/027 362/157
2008/0151545 A1 6/2008 Kratz
2012/0020061 A1 * 1/2012 Schefers ..... F21S 9/03 362/183
2012/0113629 A1 * 5/2012 Steele ..... F21V 21/12 362/190
2015/0003050 A1 * 1/2015 Parsons ..... F21L 4/005 362/158

* cited by examiner

FIG. 6A
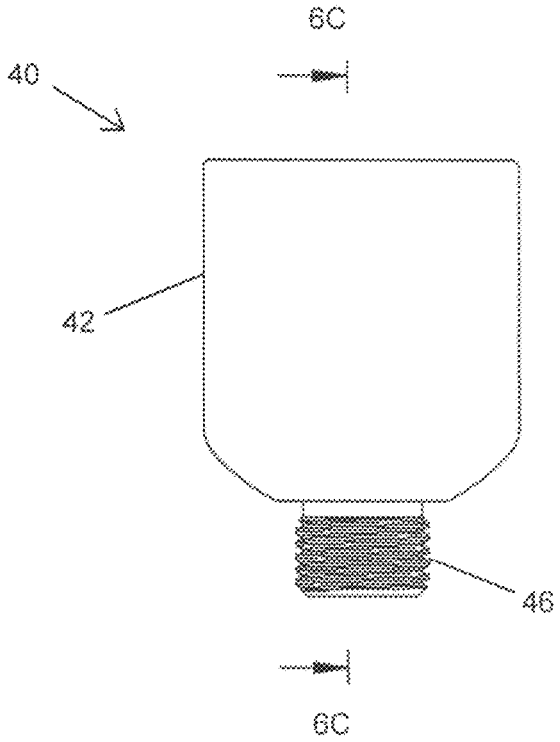
FIG. 6C
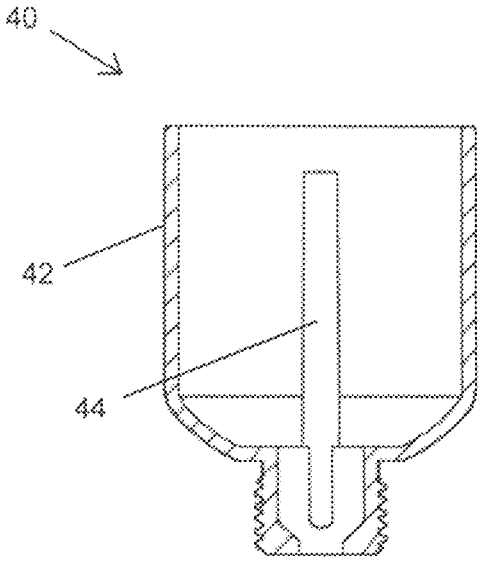
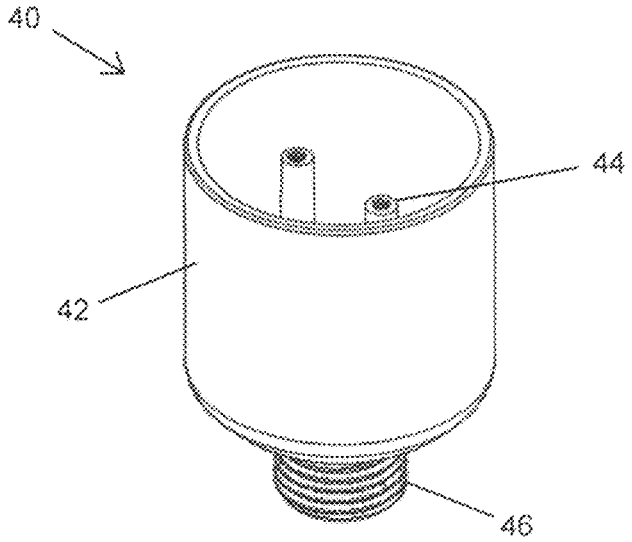
FIG. 6B
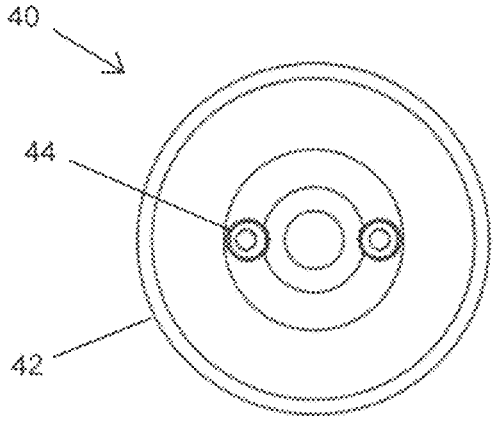
FIG. 6D

FIG. 7A
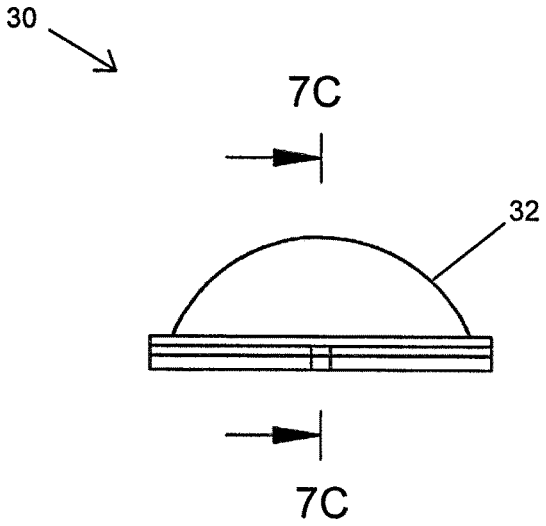
FIG. 7C
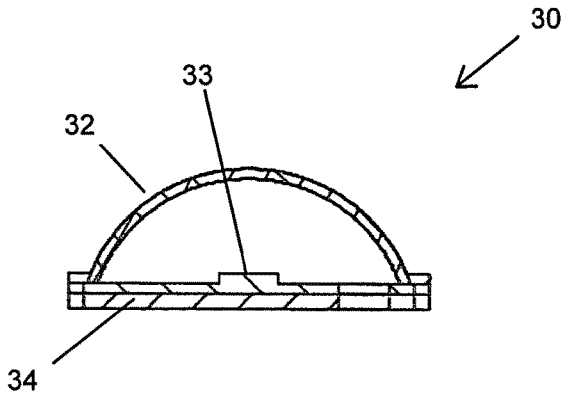
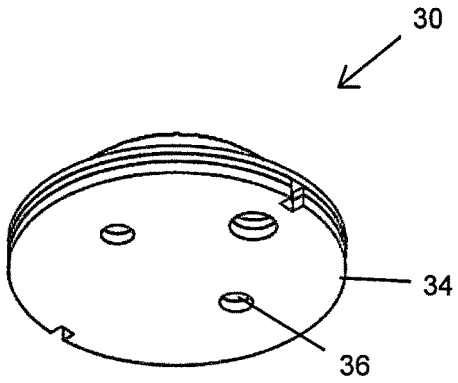
FIG. 7B
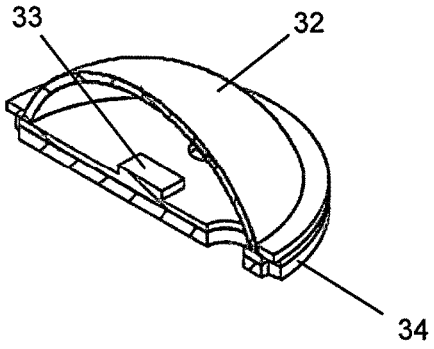
FIG. 7D

FIG. 8C
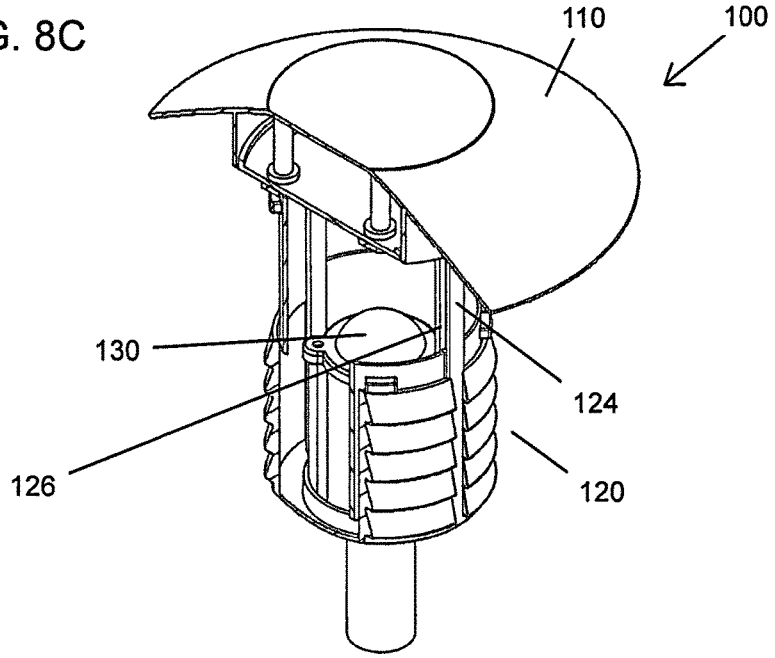
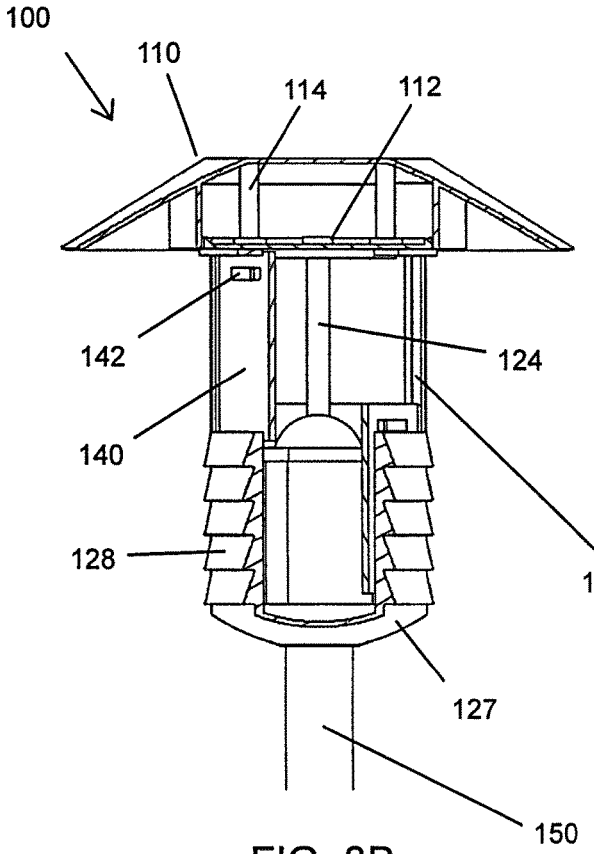
FIG. 8B
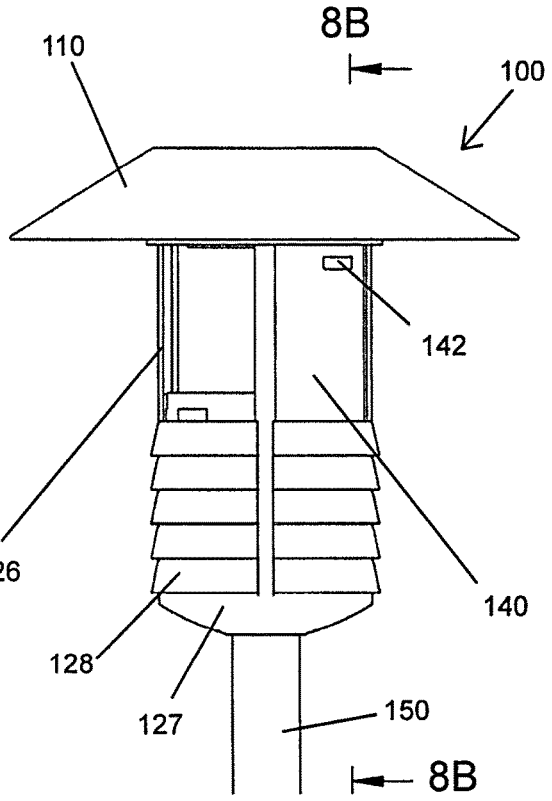
FIG. 8A

FIG. 11C
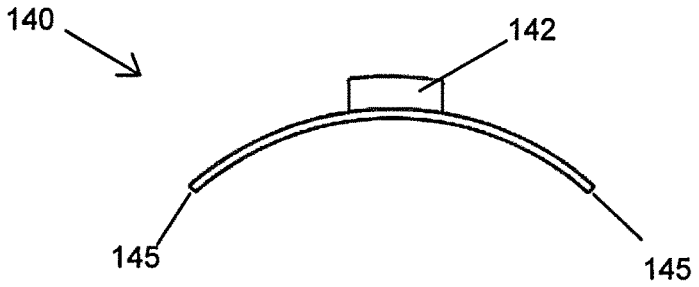
FIG. 11B
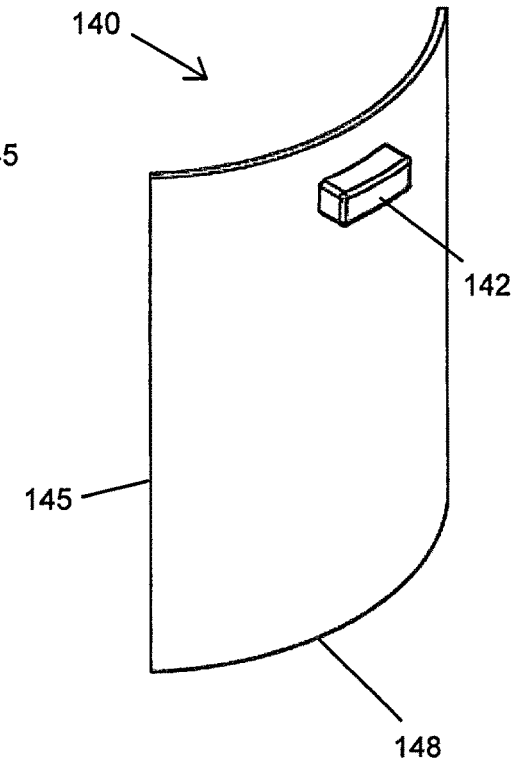
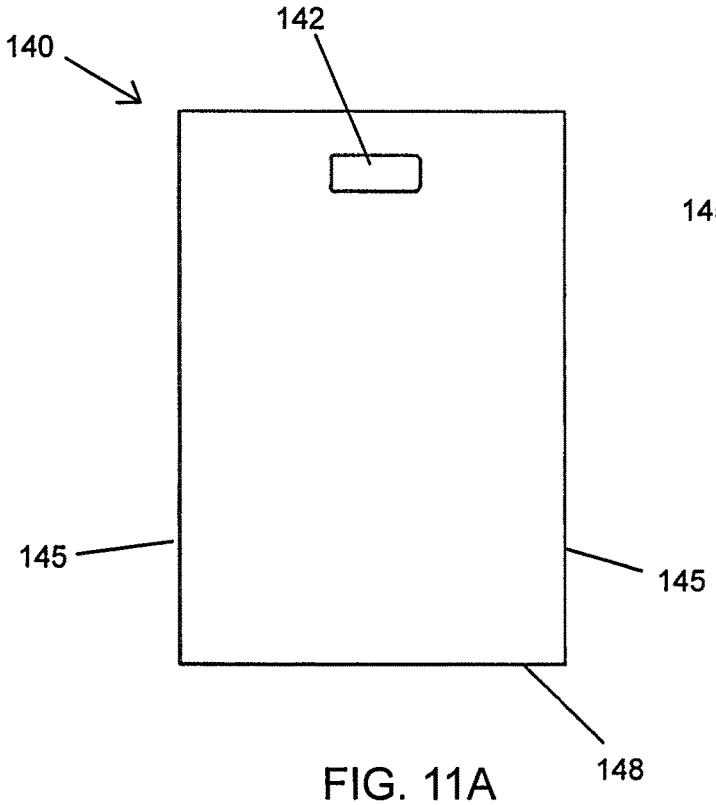
FIG. 11A

LANDSCAPE LAMPS WITH ADJUSTABLE LIGHT MODIFIERS

FIELD OF INVENTION

This invention relates to pathway and landscape lights, and in particular to devices, apparatus, systems, and methods for providing pathway and landscape lights with vertically adjustable top covers over the lights to control light patterns and with raiseable and lowerable side shades for the lights for adjusting light patterns emitting from the lights.

BACKGROUND AND PRIOR ART

Pathway and landscape lights have become increasingly popular over the last several years for providing light to pathways, sidewalks and driveways, and the like.

Typical pathway and landscape lights have a light source with a fixed shade cover on top of a pole that can be inserted into the ground adjacent to pathways, sidewalks and driveways. A typical U.S. Patent in this technology includes U.S. Design Pat. No. D500,161 to Bucher et al. which is incorporated by reference in its' entirety.

FIG. 1 is a prior art view of a typical ground based landscape/pathway light 1 with a fixed top cover 2. Most of these lights include a light source 4 (such as an incandescent bulb, halogen bulb or LED (light emitting diode)) on a post 5 with a ground engaging stake 8. The light source 4 has a fixed top cover 2, where 360-degree emissions 5 come out from the light source 4. The top cover 2 is not moveable to adjust the light patterns that come out the sides of the light source 4. These light sources 4 usually do not allow for adjusting and controlling light being emitted about the outer side perimeter.

Thus, the need exists for solutions to the above problems with the prior art.

SUMMARY OF THE INVENTION

A primary objective of the present invention is to provide devices, apparatus, systems, and methods for providing pathway and landscape lights with vertically adjustable top covers over the lights to control light patterns being emitted from the lights A secondary objective of the present invention is to provide devices, apparatus, systems, and methods for providing pathway and landscape lights with raiseable and lowerable side shades for the lights for adjusting light patterns emitting from the lights.

A third objective of the present invention is to provide devices, apparatus, systems, and methods for providing pathway and landscape lights with both vertically adjustable top covers over the lights to control light patterns and with raiseable and lowerable side shades for the lights for adjusting light patterns emitting from the lights.

An embodiment can include a pathway light with a vertically adjustable shade, having a fixture body having an upper end and a lower end, a light source within the fixture body, the light source for emitting light therefrom, and a vertically adjustable shade with top cover mounted adjacent to the upper end of the post, the vertically adjustable shade cover having a down position for causing the light source to reflect downward about the post from top cover. The vertically adjustable shade can have a raised position for causing the light source to reflect and emit light patterns sideways away from the post and in a downward angled direction about a perimeter of the post.

The vertically adjustable shade can include an upper moveable assembly having a top end attached to the top cover, and a bottom end, and a fixture body for supporting the light source, the upper moveable assembly for allowing the vertically adjustable shade to move from the raised position to the down position, and back to the raised position.

The upper moveable assembly can include an upper cylinder with translucent sides having an upper diameter, and a lower cylinder with translucent sides having a lower diameter being smaller than the upper diameter.

The fixture body can include a top facing opening having a diameter sized to receive the lower cylinder of the moveable assembly.

The pathway light can further include a seal ring between the lower cylinder and the fixture body.

The top cover can include a raised mid portion and perimeter edges sloping downward from the raised middle portion.

The light source can include a LED (light emitting diode).

The pathway light can include a ground engaging member for supporting the pathway light in a vertical orientation.

The vertically adjustable shade can include a moveable assembly with translucent sides having a top end attached to the top cover, and a bottom end a fixture body for supporting the light source, the bottom end of the moveable assembly for telescoping into and out of the fixture body. The moveable assembly can be used for allowing the top cover to move from the raised position to the down position, and back to the raised position.

Another embodiment can include a pathway light with a telescoping shade, having a post, a light source attached adjacent an upper end of the post for emitting light, a vertical telescoping shade with cover mounted to the post, the vertical telescoping shade can include telescoping cylinders having translucent sides for allowing light to pass through. The vertical telescoping shade can include a down position for causing the light source to reflect and emit light patterns in a downward angled direction about a perimeter of the post from the cover, and a raised position for causing the light source to reflect and emit light patterns sideways and in a downward angled direction about a perimeter of the post from the top cover; and A second embodiment of a pathway light can include a frame having a generally centrally located light source, and at least one side opening in the frame, at least one vertically adjustable side shade positioned in the at least one side opening, wherein the at least one vertically adjustable side shade opens and closes the at least one side opening, a top cover attached on top of the frame for directing light emissions from the light source away from the frame and a ground engaging member for supporting the frame over a ground surface.

The pathway light can include a pair of vertical side members in the frame for forming the at least one side opening.

Each of the side members can include vertical channels facing each other for supporting outer side edges of the at least one vertically adjustable shade.

The at least one vertically adjustable side shade can include a handle on an outside surface for allowing the at least one vertically adjustable side shade to be moved up and down.

The pathway light can further include a set of louvers about a lower portion of the at least one side opening in the frame.

The pathway light can further include a first side opening in the frame, a first pair of vertical side members in the frame forming the first side opening, and first vertical channels facing each other in the first pair of vertical side member for supporting outer side edges of a first vertically adjustable shade, a second side opening in the frame on an opposite side of the frame, a second pair of vertical side members in the frame forming the second side opening, and second vertical channels facing each other in the second pair of vertical side member for supporting outer side edges of a second vertically adjustable shade.

The pathway light can further include a plurality of side openings about a perimeter of the frame, a plurality of parallel spaced apart side by side vertical side members about t perimeter of the frame forming the plurality of the side openings, a plurality of vertical channels facing each other in the side by side vertical side members, and a plurality of vertically adjustable side shades, each in the plurality of the parallel spaced apart side by side vertical side members, wherein side edges of each of the plurality of the vertically adjustable side shades slides within the plurality of the vertical channels.

The pathway light can further include a first handle for the first vertically adjustable shade, for raising and lowering the first vertically adjustable shade, and a second handle for the second vertically adjustable shade, for raising and lowering the second vertically adjustable shade.

The pathway light can further include a plurality of handles, each of the handles for raising and lowering each of the plurality of vertically adjustable side shades.

The second embodiment of the pathway light with vertically adjustable side shades can include a frame having a generally located light source, a plurality of side openings in the frame, a plurality of vertically adjustable side shades, each of the shades being positioned within each of the side openings of the frame, each vertically adjustable side shade opens and closes each side opening to allow light emissions from the light source to be emitted from the pathway light, a top cover on the frame, and a post having an upper end attached beneath the frame and an opposite end for being inserted into a ground surface for allowing the pathway light to be vertically oriented.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

First Embodiment

Figure 1:
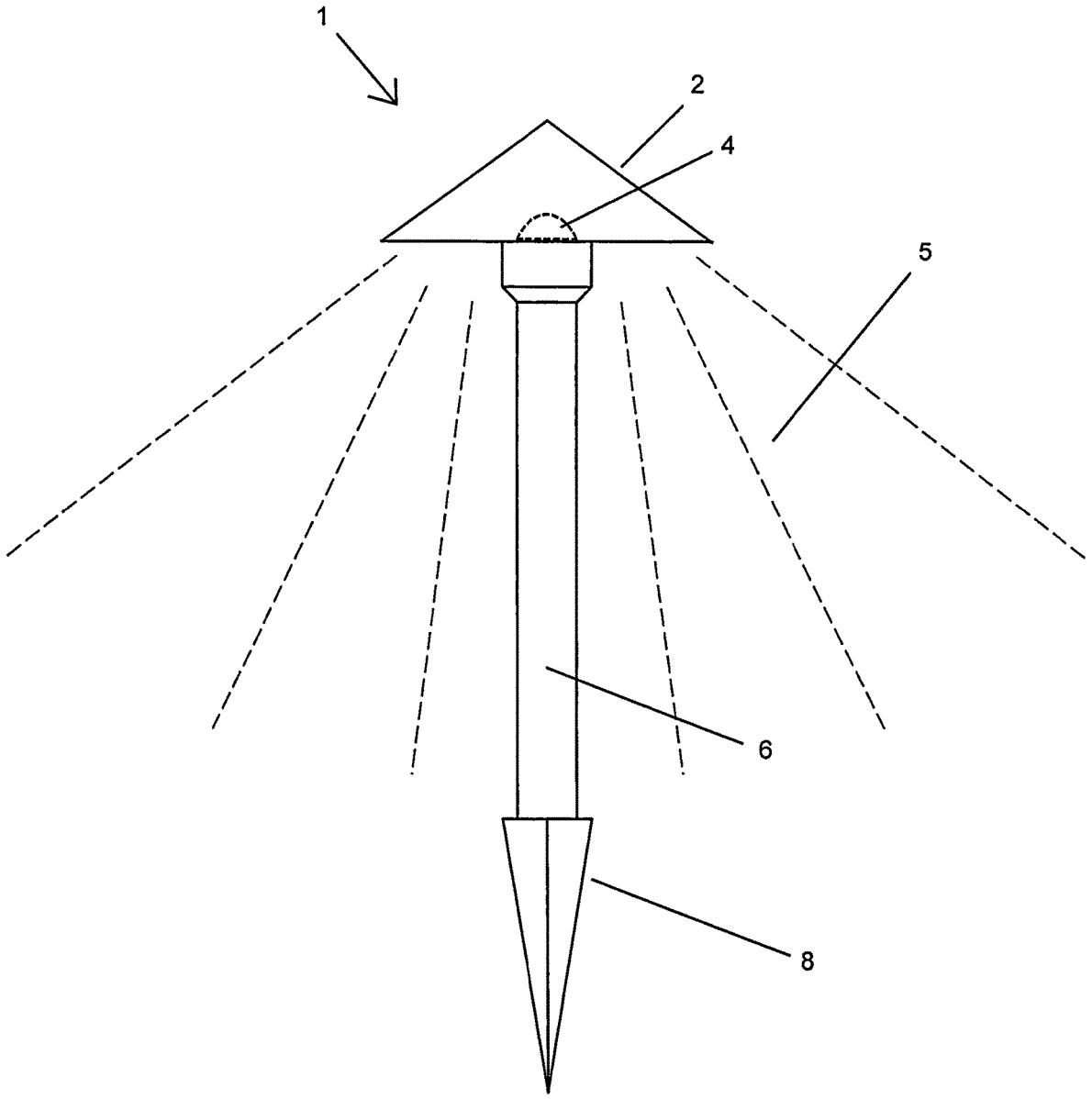
FIG. 1 (Prior Art)
FIG. 1 is a prior art view of a ground based landscape/pathway light with a fixed top cover.
Figure 2A:
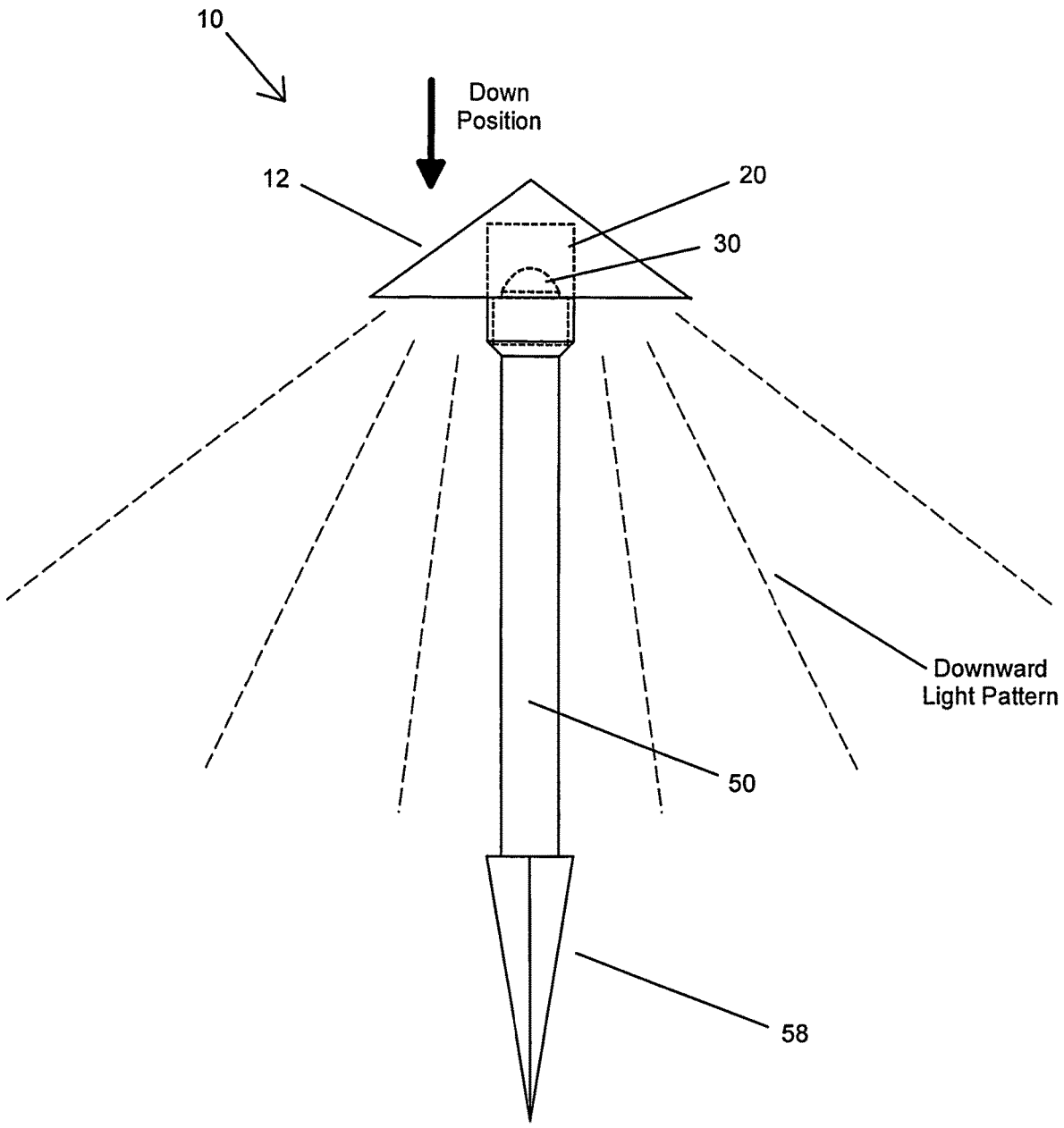

FIG. 2A is a front view of a first preferred embodiment of a landscape light with a vertically adjustable top cover over a light source in a down position with ghosted insides.

FIG. 26 is an enlarged cross-sectional view of the top cover and light source portion with the top cover in a down position shown in FIG. 2A.

Figure 2B:
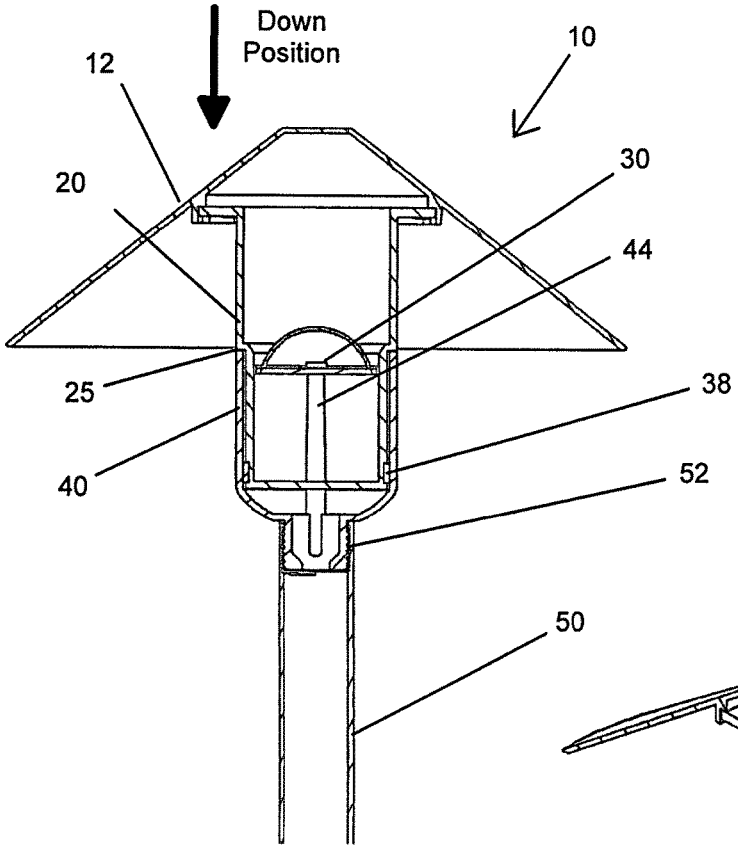
Figure 2C:
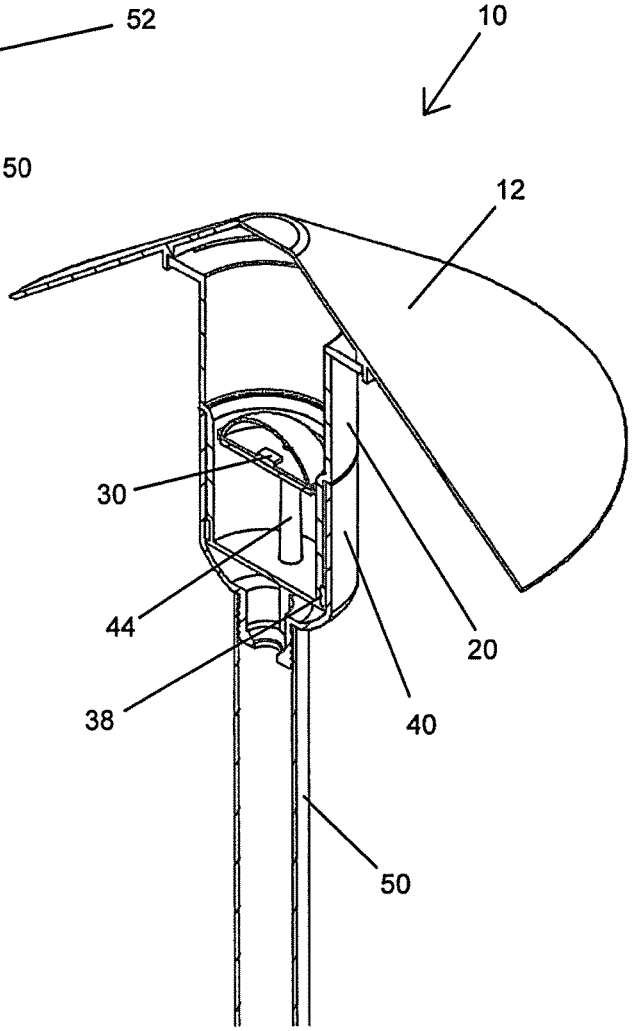

FIG. 2C is a perspective view of the enlarged cross-sectional view of the top cover and light source portion with the top cover in a down position shown in FIG. 2B.

Figure 3A:
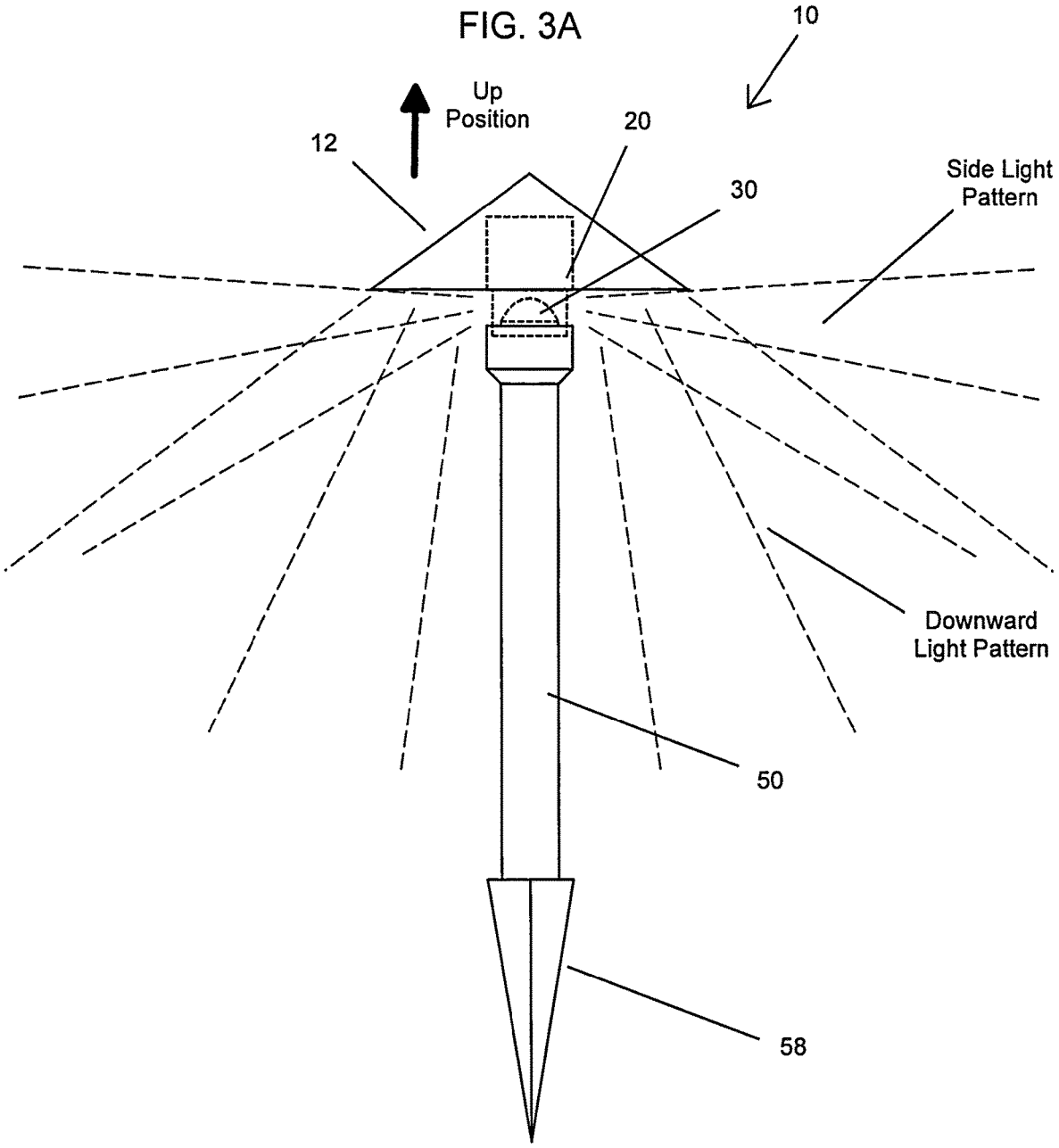

FIG. 3A is a front view of the first preferred embodiment the landscape light of FIG. 2A with the vertically adjustable top cover over the light source in a raised-up position with ghosted insides.

Figure 3B:
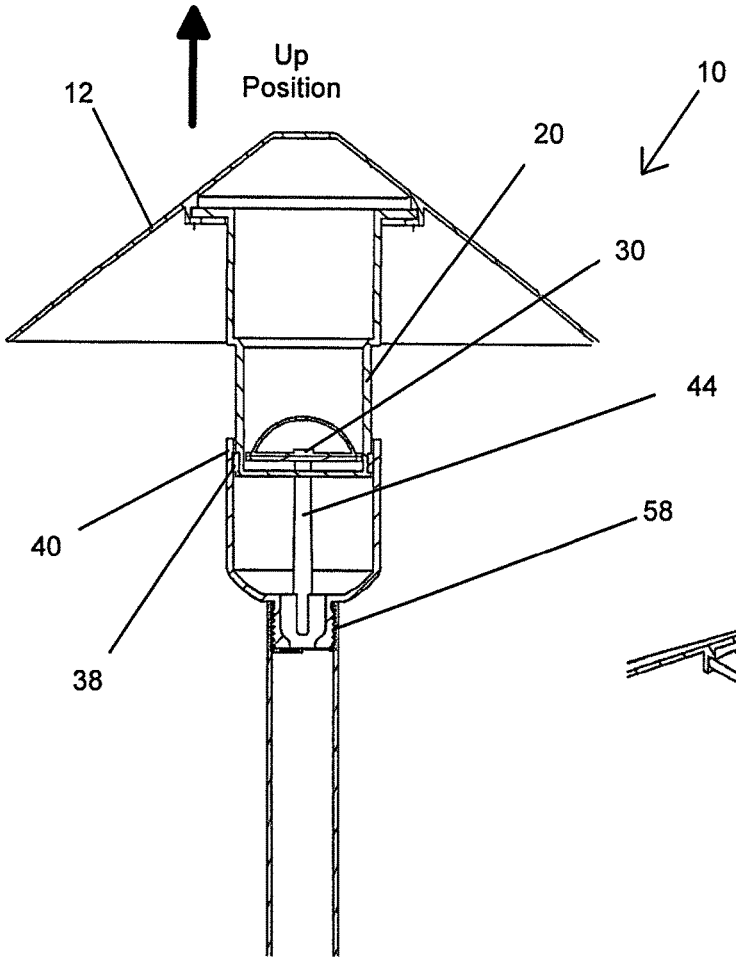

FIG. 3B is an enlarged cross-sectional view of the top cover and light source position with the top cover in a raised-up position shown in FIG. 3A.

Figure 3C:
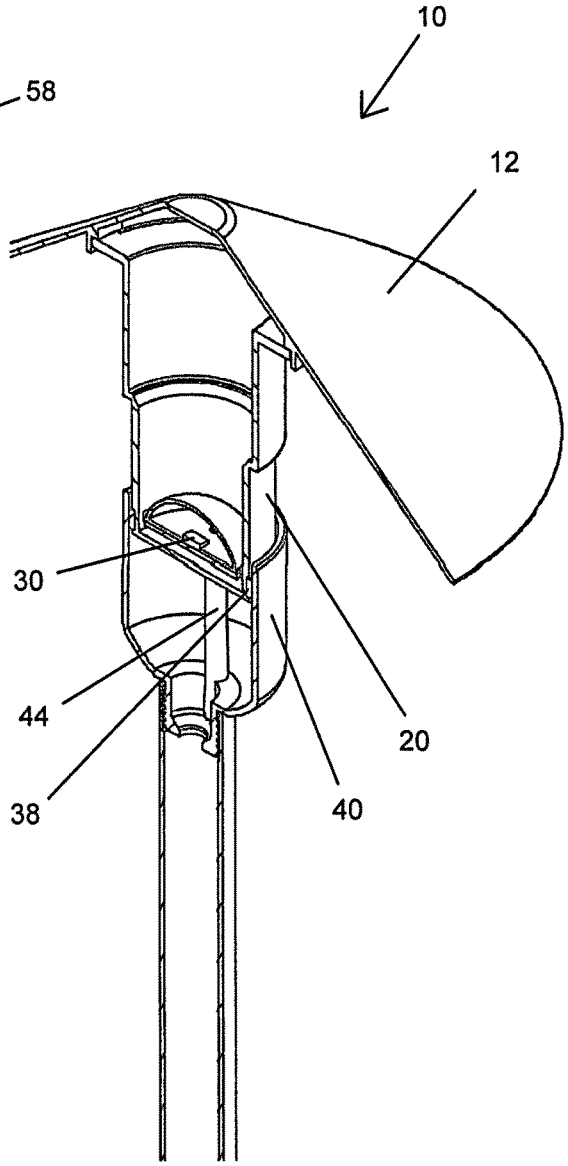

FIG. 3C is a perspective view of the enlarged cross-sectional view of the top cover and light source portion with the top cover in a raised-up position shown in FIG. 3B.

Figure 3D:
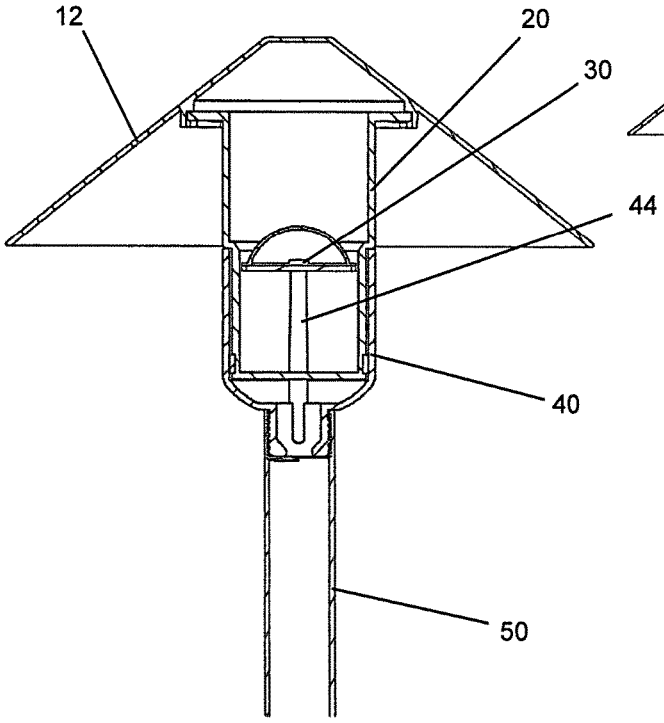

FIG. 3D is another view of FIG. 2B showing the enlarged cross-sectional view of the top cover and light source portion with the top cover in a down position shown in FIG. 2A.

Figure 3E:
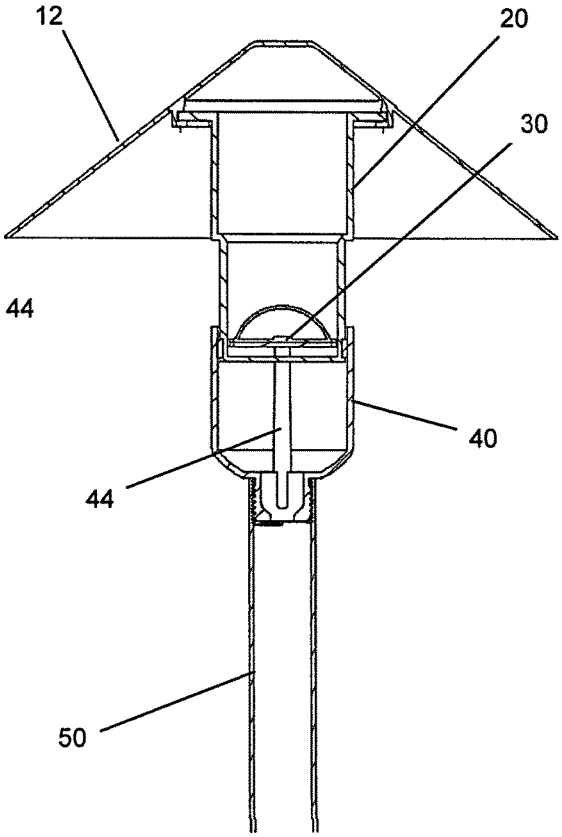

FIG. 3E is another view of FIG. 3B showing the enlarged cross-sectional view of the top cover and light source position with the top cover in a raised-up position shown in FIG. 3A.

Figure 4A:
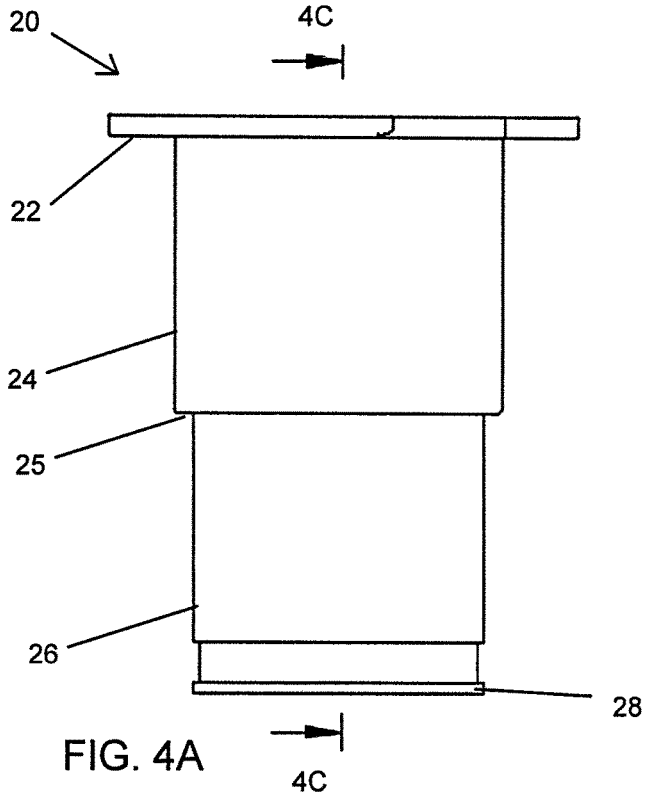

FIG. 4A is a front view of the vertically adjustable shade base of the top cover of the preceding FIGURES.

Figure 4C:
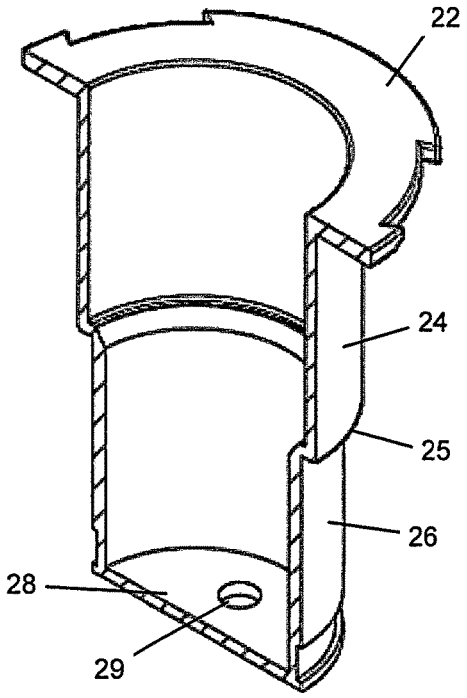
Figure 4B:
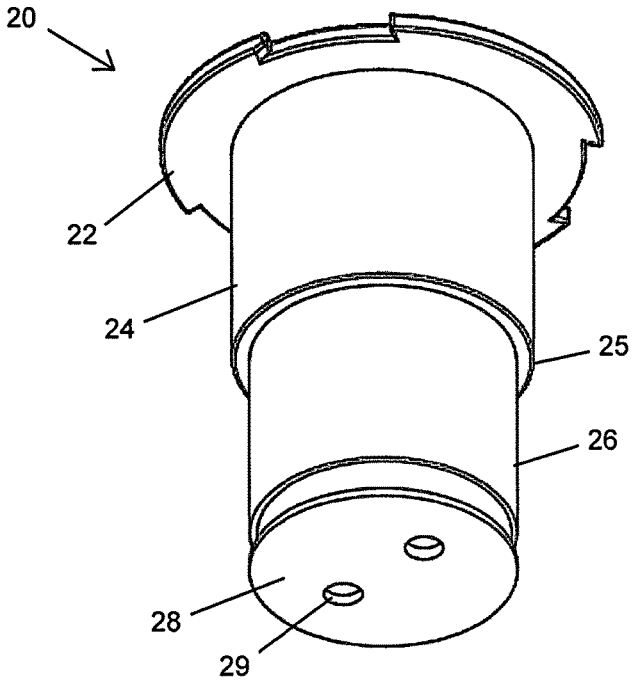

FIG. 4B is a lower front perspective view of the vertically adjustable shade base of the top cover of FIG. 4A FIG. 4C is a perspective cross-sectional view of the vertically adjustable shade base of the top cover of FIG. 4A along arrows 4C.

Figure 5:
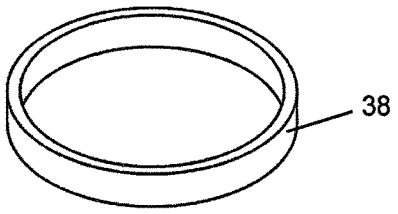

FIG. 5 is a perspective view of the rubber seal sleeve used between the vertically adjustable shade base and the fixture body shown in FIGS. 1A-3C.

FIG. 6A is a front view of the fixture body shown in FIGS. 1A-3C.

FIG. 6B is an upper front perspective view of the fixture body of FIG. 6A.

FIG. 6C is a side cross-sectional view of the fixture body of FIG. 6A along arrows 6C.

FIG. 6D is a top view of the fixture body of FIG. 6A along arrow 6D.

FIG. 7A a front view of the light source shown in FIG. 1A-1C.

FIG. 7B is a lower front perspective view of the light source of FIG. 7A.

FIG. 7C is a cross-sectional view of the light source of FIG. 7A along arrow 7C of FIG. 7A.

FIG. 7D is a perspective view of the cross-sectional view of FIG. 7C showing a cross-sectional view of the light source of FIG. 7A along arrow 7C of FIG. 7A.

Second Embodiment

FIG. 8A is a front view of a second preferred embodiment of a landscape light with fixed top cover over a light and vertically adjustable side shades on a frame.

FIG. 8B is a cross-sectional view of the landscape light with fixed top cover over a light and vertically adjustable side shades on a frame of FIG. 8A along arrows 8B.

FIG. 8C is a perspective view of the cross-sectional view of FIG. 8B.

Figure 9A:
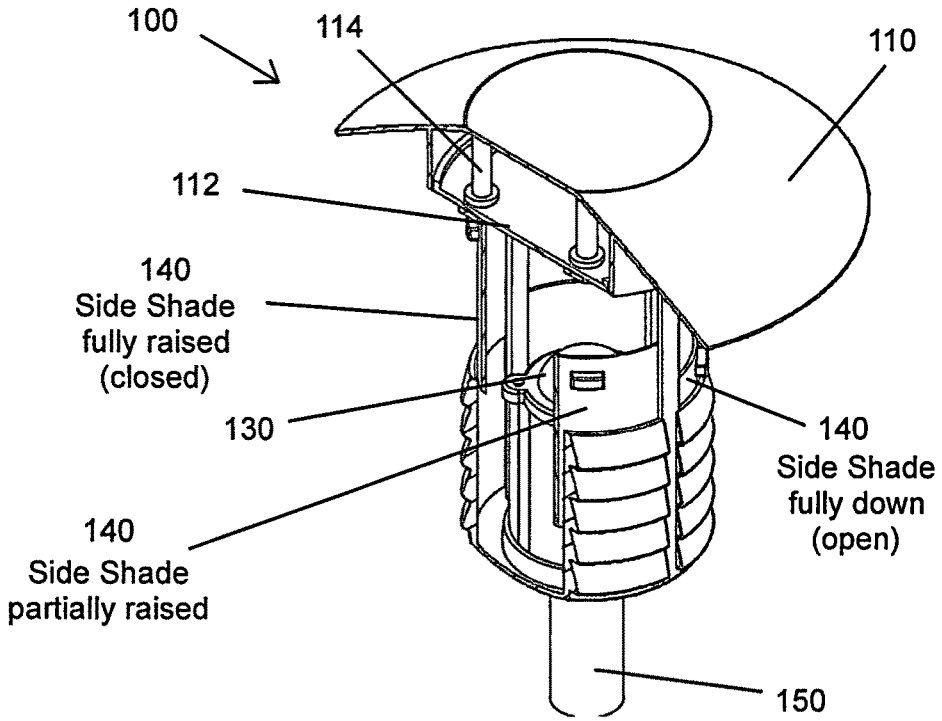

FIG. 9A is another perspective view of the cross-sectional view of FIG. 8C with one side shade pulled down to a fully open position, and another side shade fully raised to a closed position.

Figure 9B:
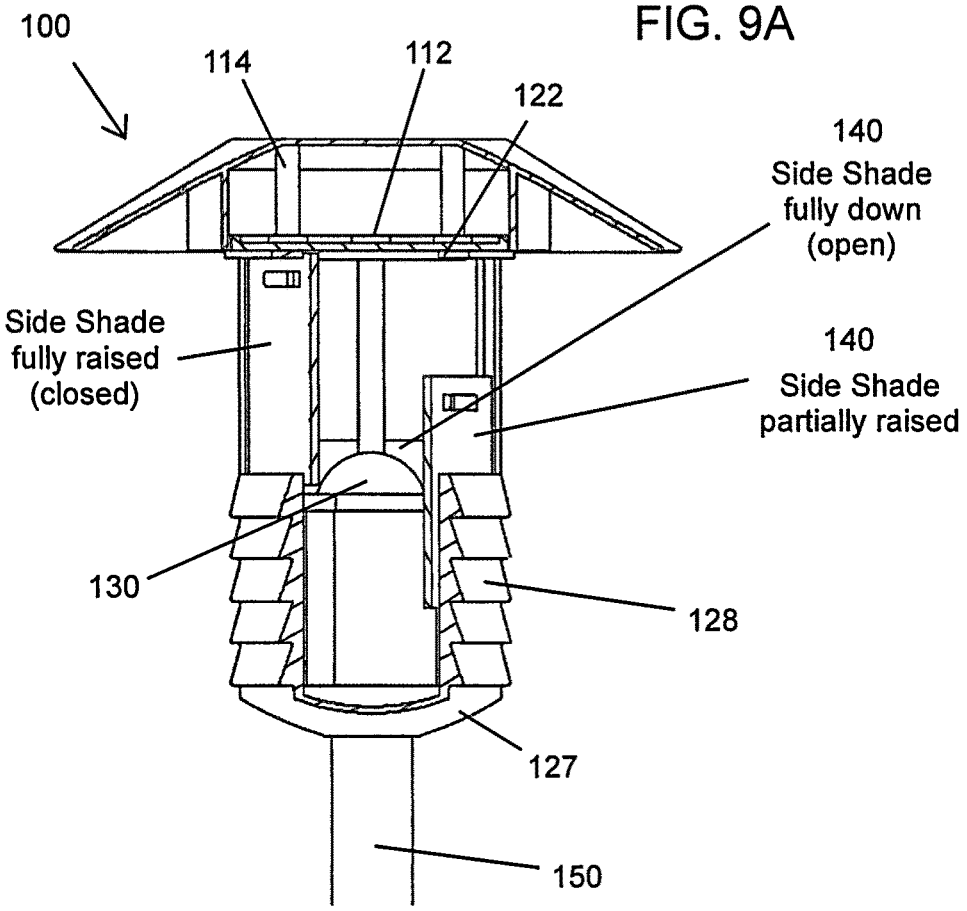

FIG. 9B is another side cross-sectional view of FIG. 9A with one side shade in a fully open position and another side shade partially raised.

Figure 10A:
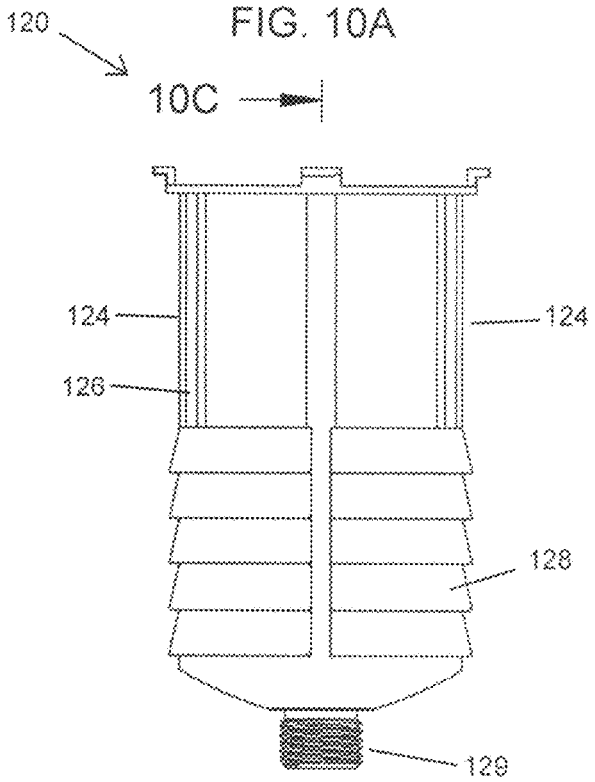

FIG. 10A is a front view of the frame of FIGS. 8A-8C without the side shades on the frame.

Figure 10C:
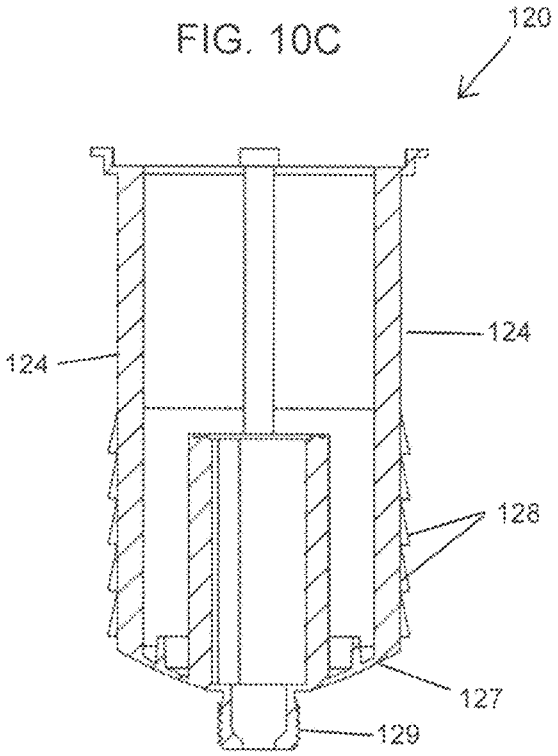
Figure 10B:
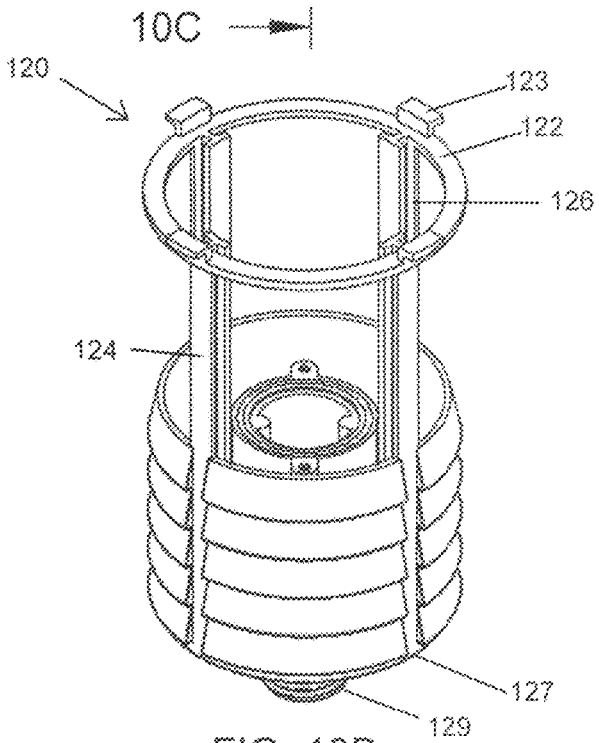

FIG. 10B is an upper front perspective view of the fame without side shades on the frame of FIG. 10A.

FIG. 10C is a side cross-sectional view of the frame without side shades on the frame of FIG. 10A along arrows 10C.

Figure 10D:
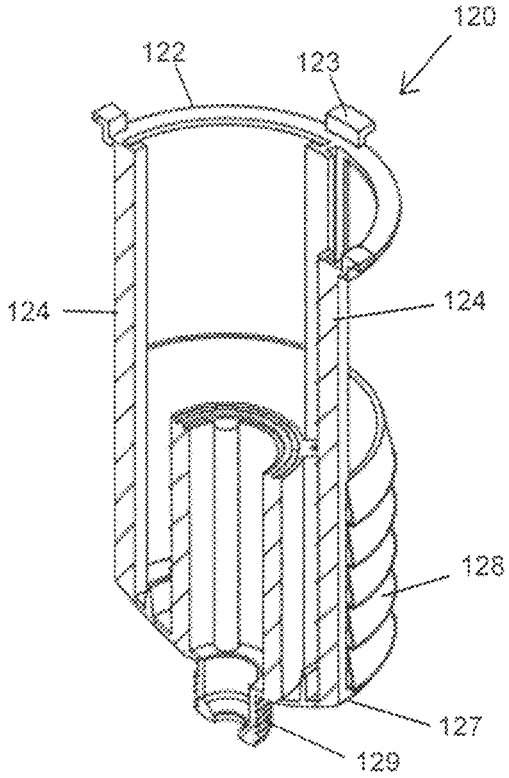

FIG. 10D is a perspective view of the side cross-sectional view of the frame without side shades on the frame of FIG. 10C.

FIG. 11A is an enlarged front view of one side shade of FIGS. 8A-9B.

FIG. 11B is a perspective view of the side shade of FIG. 11A.

FIG. 11C is a top view of the side shade of FIG. 11A.

Figure 12A:
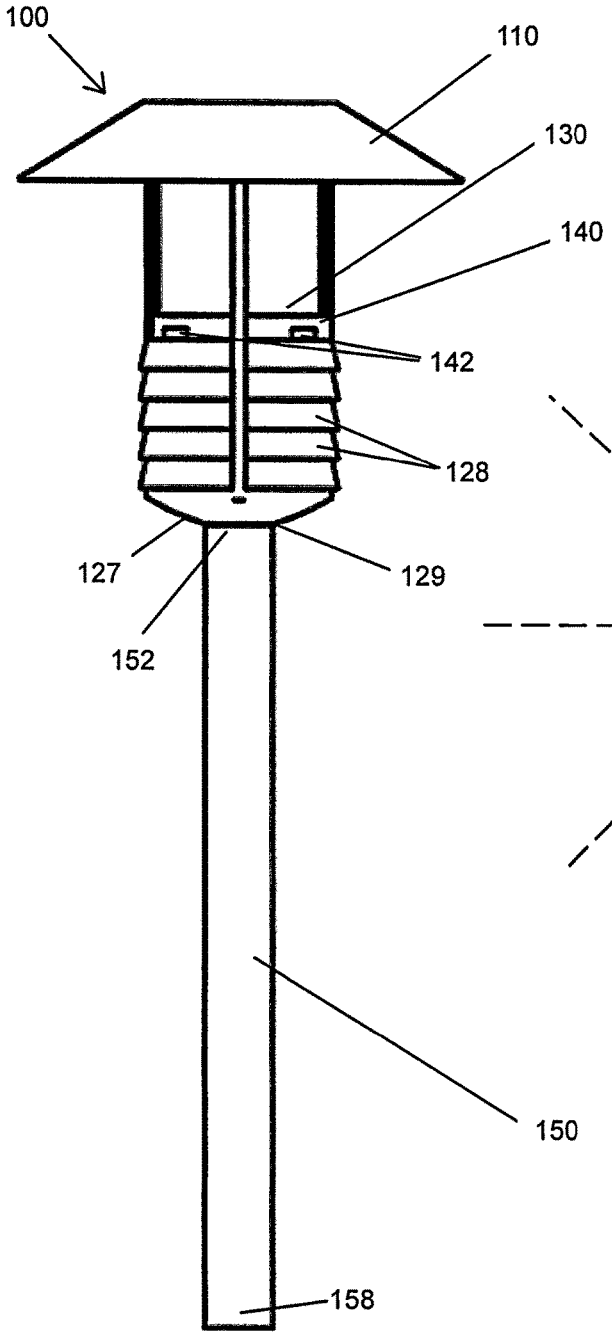

FIG. 12A is a side view the second preferred embodiment of the landscape light with fixed top cover over a light and vertically adjustable side shades on a frame attached to a support post of the preceding figures with all four side shades fully open.

Figure 12B:
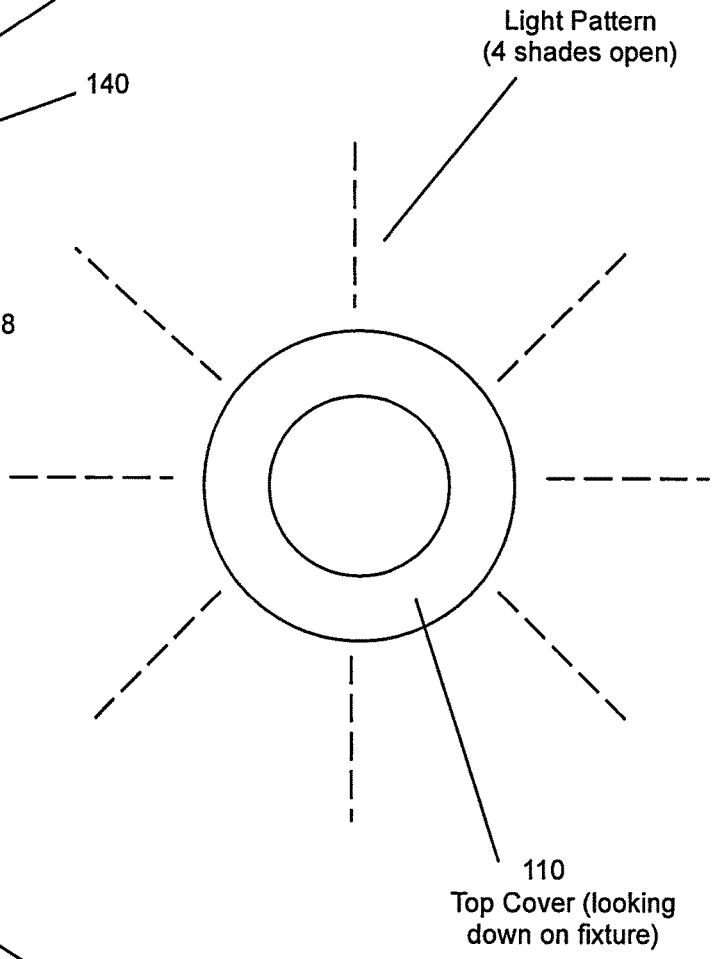

FIG. 12B is a top view of the landscape light with fixed top cover over a light and vertically adjustable side shades on a frame attached to a support post of FIG. 12A showing the outwardly directed light patterns.

Figure 13A:
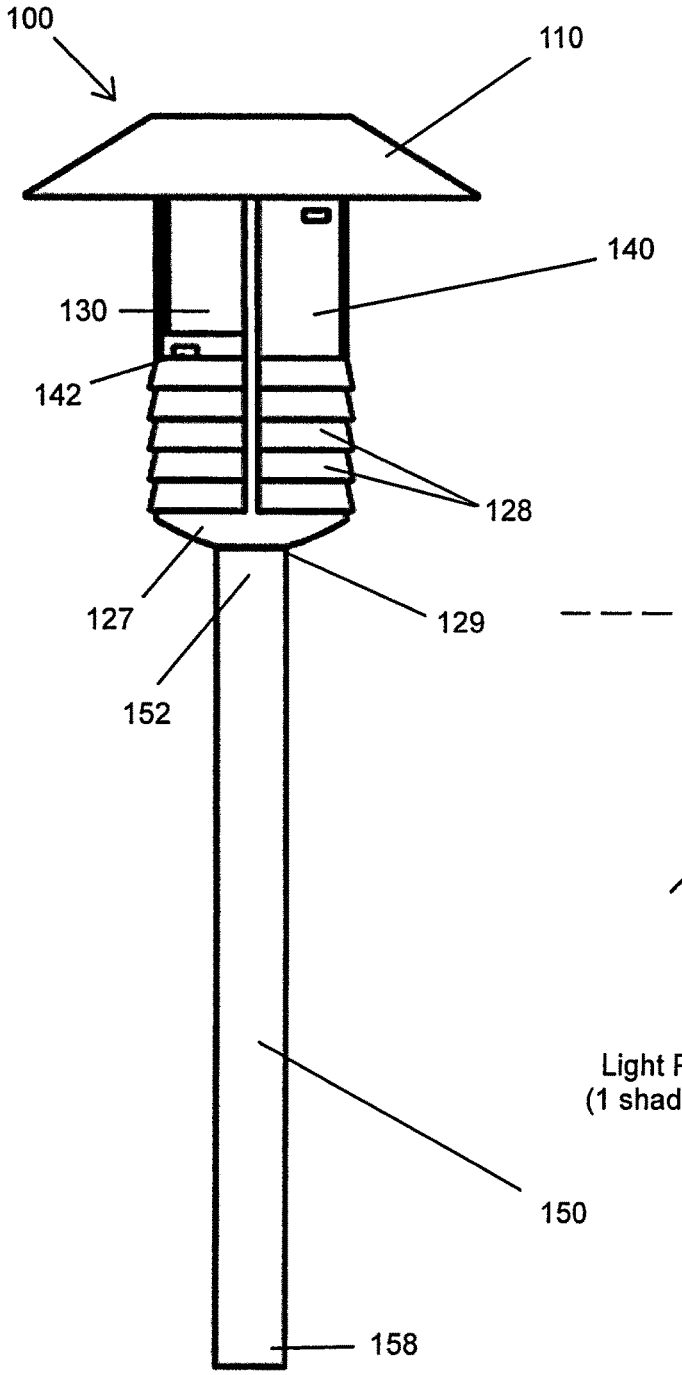

FIG. 13A is a side view the second preferred embodiment of the landscape light with fixed top cover over a light and vertically adjustable side shades on a frame attached to a support post of the preceding figures with one of the side shades fully open.

Figure 13B:
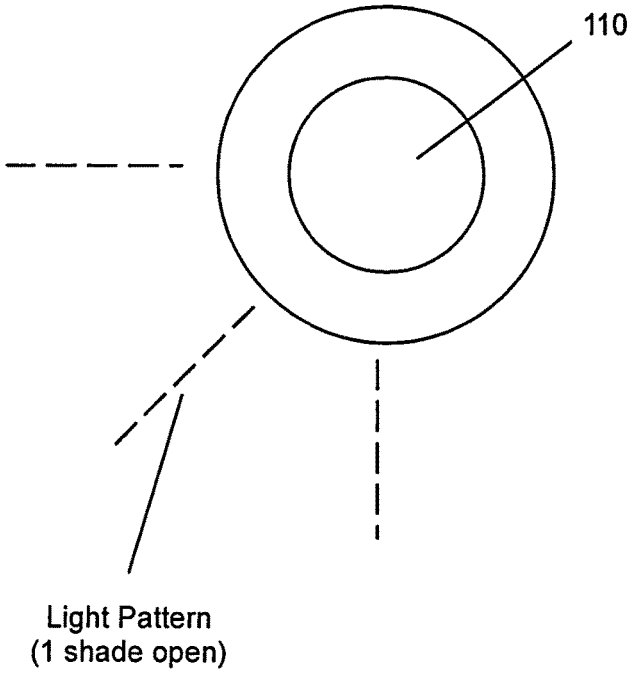

FIG. 13B is a top view of the landscape light with fixed top cover over a light and vertically adjustable side shades on a frame attached to a support post of FIG. 13A showing the outwardly directed light patterns.

Figure 14A:
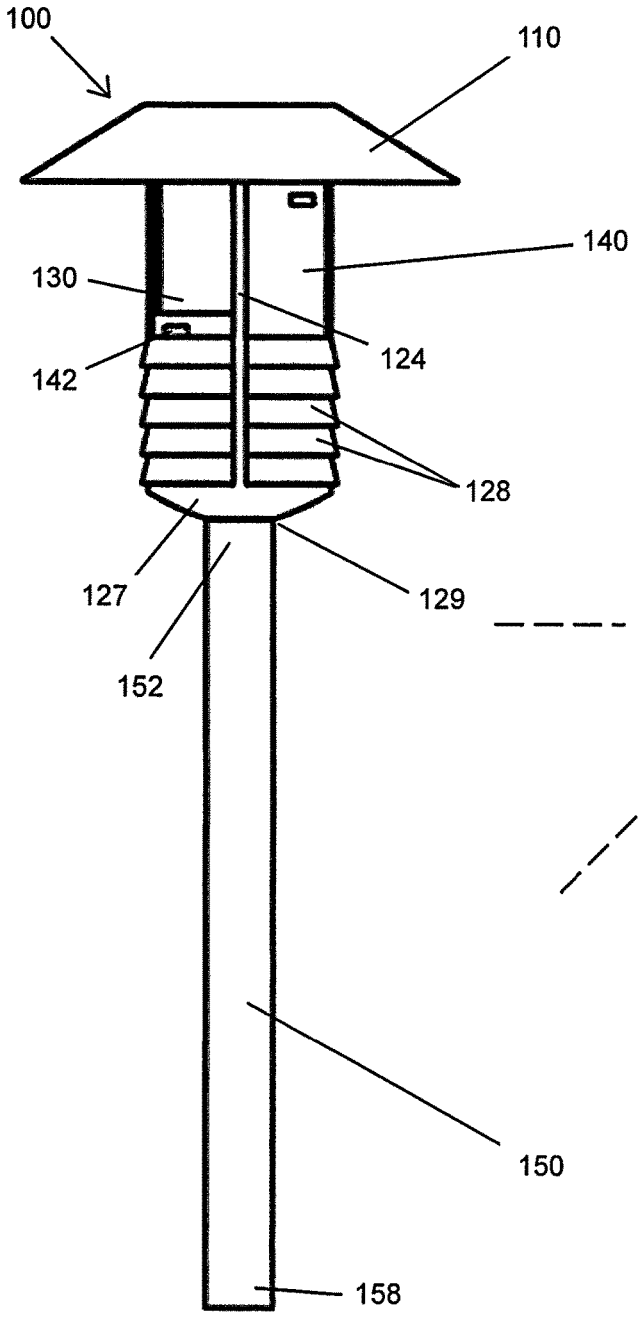

FIG. 14A is a side view the second preferred embodiment of the landscape light with fixed top cover over a light and vertically adjustable side shades on a frame attached to a support post of the preceding figures with two opposing side shades fully open and two other opposing side shades fully closed.

Figure 14B:
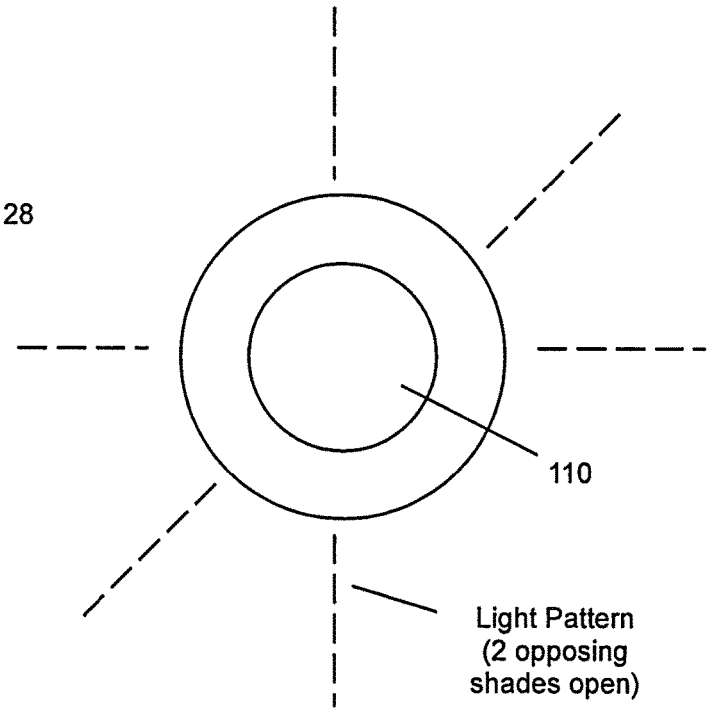

FIG. 14B is a top view of the landscape light with fixed top cover over a light and vertically adjustable side shades on a frame attached to a support post of FIG. 14A showing the outwardly directed light patterns.

Figure 15A:
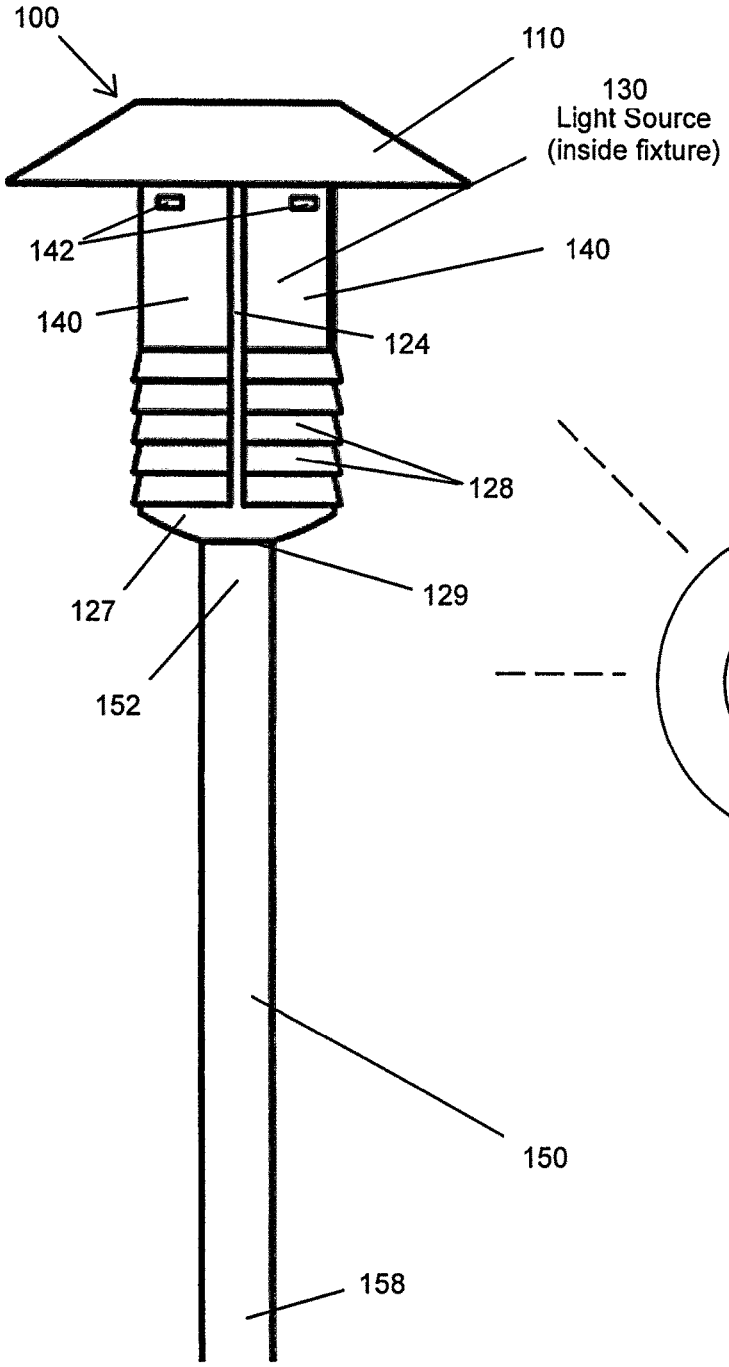

FIG. 15A is a side view the second preferred embodiment of the landscape light with fixed top cover over a light and vertically adjustable side shades on a frame attached to a support post of the preceding figures with rear facing side shades fully open and front facing side shades fully closed.

Figure 15B:
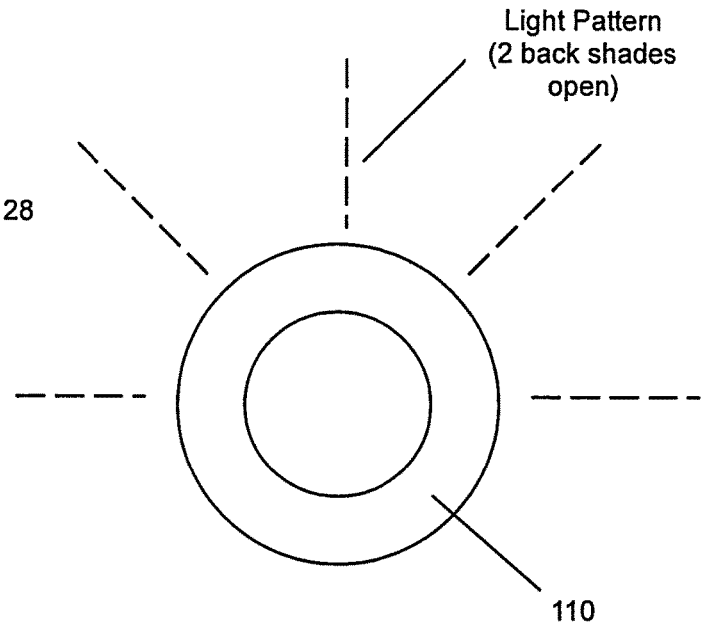

FIG. 15B is a top view of the landscape light with fixed top cover over a light and vertically adjustable side shades on a frame attached to a support post of FIG. 15A showing the outwardly directed light patterns.

Figure 16A:
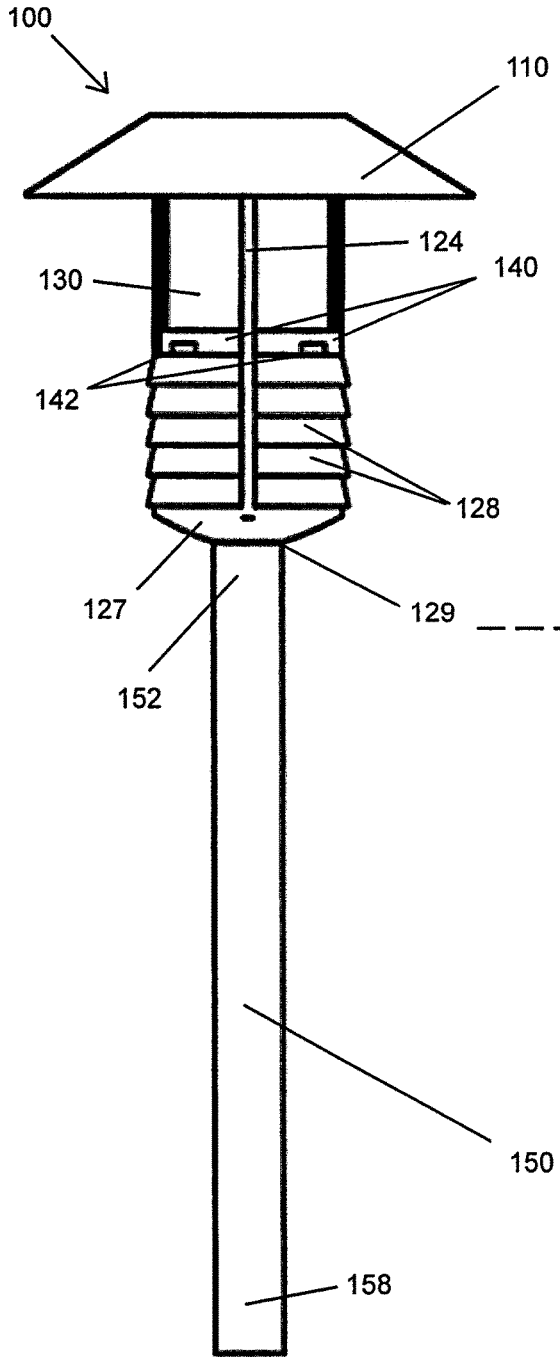

FIG. 16A is a side view the second preferred embodiment of the landscape light with fixed top cover over a light and vertically adjustable side shades on a frame attached to a support post of the preceding figures with three of four adjacent side shades fully open and the remaining side shade fully closed.

Figure 16B:
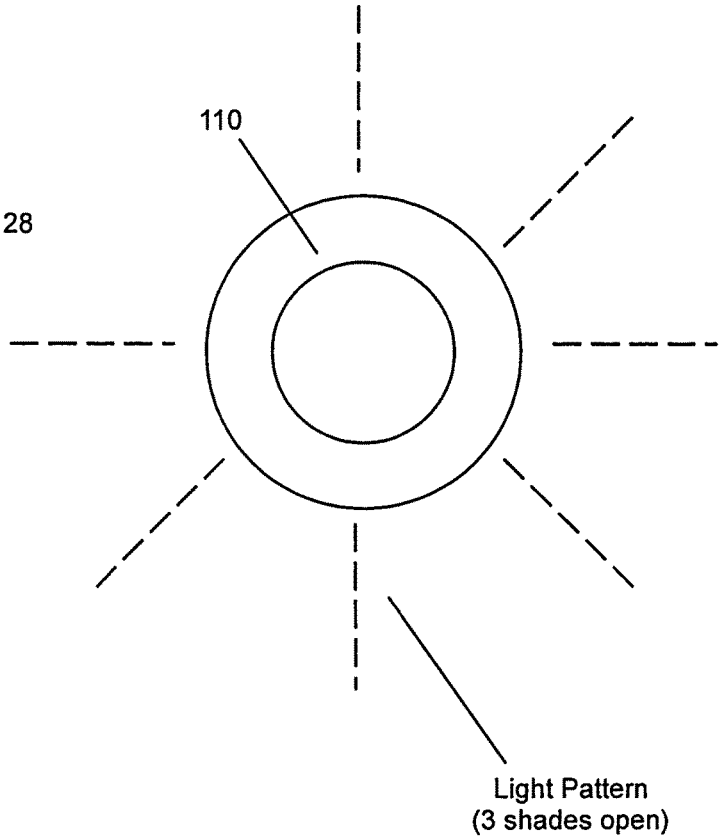

FIG. 16B is a top view of the landscape light with fixed top cover over a light and vertically adjustable side shades on a frame attached to a support post of FIG. 16A showing the outwardly directed light patterns.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

A list of components will now be described.

1. Landscape light/pathway light with fixed top cover
2. fixed top cover
4. light source
5. light pattern
6. post
8. stake
10. Vertically Adjustable Cover Embodiment
12. vertically adjustable top cover
20. vertically adjustable shade body
22. top rim
24. upper cylindrical shade with translucent sides
25. step
26. lower cylindrical shade with translucent sides
28. bottom of lower cylindrical shade
29. holes for light source support posts
30. light source
32. Dome cover over the LED (light emitting diode)
33. light LED (light emitting diode)
34. base of light source
36. holes in base
38. seal sleeve
40. fixture body
42. Open top cylinder
44. support posts for light source
46. exterior threaded stem
50. main post
52. upper end main post with interior threads
58. ground engaging stake at bottom end of the main post
100. Slidable Side Shades Embodiment

110. top cover
112. base of top cover
114. support posts for cover
120. frame
122. top rim
123. outwardly projecting tabs
124. side vertical frame member
126. side channels in vertical frame member
127. base of frame
128. decorative side louvers
129. threaded stem
130. light source
140. slidable concave curved side shade(s)
142. handle on outside of curved side shade
145. side edges of shade
148. bottom of shade
150. Post for light 100
152. upper end with threaded socket for threaded stem 129
158. lower end with or without ground engaging stake First Embodiment FIG. 2A is a front view of a first preferred embodiment of a landscape light embodiment 10 with a vertically adjustable top cover 12 over a light source 30 in a down position with ghosted insides. The top cover 12 can have a raised middle portion and downwardly sloping sides, or sides that will be used to reflect light emissions downward or both downward to outward to the sides.

FIG. 2B is an enlarged cross-sectional view of the top cover 12 and light source portion 30 with the top cover 12 in a down position of the embodiment 10 shown in FIG. 2A.

FIG. 2C is a perspective view of the enlarged cross-sectional view of the top cover 12 and light source portion 30 with the top cover 12 in a down position shown in FIG. 2B.

FIG. 3A is a front view of the first preferred embodiment 10 the landscape light of FIG. 2A with the vertically adjustable top cover 12 over the light source 30 in a raised-up position with ghosted insides.

FIG. 3B is an enlarged cross-sectional view of the vertically adjustable top cover 12 and light source position with the vertically adjustable top cover 12 in a raised-up position shown in FIG. 3A.

FIG. 3C is a perspective view of the enlarged cross-sectional view of the vertically adjustable top cover 12 and light source portion 30 with the vertically adjustable top cover 12 in a raised-up position shown in FIG. 3B.

FIG. 3D is another view of FIG. 2B showing the enlarged cross-sectional view of the vertically adjustable top cover 12 and light source portion 40 with the top cover 12 in a down position shown in FIG. 2A.

FIG. 3E is another view of FIG. 3B showing the enlarged cross-sectional view of the vertically adjustable top cover 12 and light source portion 30 with vertically adjustable top cover 12 in a raised-up position shown in FIG. 3A. FIG. 4A is a front view of the vertically adjustable shade body 20 of the top cover of the preceding FIGURES.

FIG. 4B is a lower front perspective view of the vertically adjustable shade body 20 of the top cover 12 of FIG. 4A FIG. 4C is a perspective cross-sectional view of the vertically adjustable shade body 20 of the top cover 12 of FIG. 4A along arrows 4C.

FIG. 5 is a perspective view of the rubber seal sleeve 38 used between the vertically adjustable shade body 20 and the fixture body 40 shown in FIGS. 1A-3C.

FIG. 6A is a front view of the fixture body 40 shown in FIGS. 1A-3C.

FIG. 6B is an upper front perspective view of the fixture body 40 of FIG. 6A.

FIG. 6C is a side cross-sectional view of the fixture body 40 of FIG. 6A along arrows 6C.

FIG. 6D is a top view of the fixture body 40 of FIG. 6A along arrow 6D.

FIG. 7A a front view of the light source 30 shown in FIG. 1A-1C.

FIG. 7B is a lower front perspective view of the light source 30 of FIG. 7A.

FIG. 7C is a cross-sectional view of the light source 30 of FIG. 7A along arrow 7C of FIG. 7A.

FIG. 7D is a perspective view of the cross-sectional view of FIG. 7C showing a cross-sectional view of the light source 30 of FIG. 7A along arrow 7C of FIG. 7A.

Referring to FIGS. 2A-7D, the vertically adjustable cover embodiment 10 includes a light source 30 that can include a dome cover 32 over the light LED (light emitting diode) 33 having support posts 44 fixably supporting the light source 30 to the fixed body.

The vertically adjustable shade body 20 has a top rim 22 that is received into the top cover 12 so that both the shade body 20 with attached top cover 12 become vertically adjustable relative to the fixture body 40, which will now be described.

The vertically adjustable shade body 20 can include an upper cylindrical shade 24 having a larger diameter that steps down 35 to a narrower diameter lower cylindrical shade 26. The lower cylindrical shade 26 is sized to slide vertically inside of the open topped cylinder 42 of the fixture body 40.

Both the upper cylindrical shade 24 and the lower cylindrical shade 26 have translucent sides to allow light from the light source 30 to pass through the shade body 20.

A seal ring 38 such as but not limited to a rubber type gasket allows for outer wall of the lower cylindrical shade 26 to sealingly slide inside the open topped cylinder 42 of the fixture body 40 and allow the shade body 20 to be fixed in the desired position.

In a down position of the vertically adjustable top cover 12 shown in FIGS. 2A and 3B, light from the light source 30 is directed primarily upward and reflects downward from the inner surface of top cover 12.

In the up position of the vertically adjustable top cover 12 shown in FIG. 3A, light from the light source 30 is also directed upward. The side walls of both the upper cylindrical shade 24 and the lower cylindrical shade 26 which have translucent sides and reflects both downward from the top cover 12 and outwardly sideways from the shade body 20 and inner surface of the top cover 12.

In the down position as shown in FIGS. 2B, 2C, 3D, 4A-4C, the step 25 provides a limiting stop for lowering the upper cylinder 24 into the lower cylinder 26, with the step 25 resting or abutting against the upper edge of the fixture body 40.

In the up position, the bottom of lower cylindrical shade 28 will prevent the shade body 20 from pulling out of the fixture body 40 by contacting the base of light source 34.

Referring to FIGS. 2A-7D. the exterior threaded stem 46 under the fixture body 40 can be rotated into the interior threads 52 of the main post 50, and the stake 58 at the end of the main post 50 can be inserted into the ground to support the vertically adjustable light cover embodiment.

While the upper cylindrical shade 24 and the lower cylindrical shade 26 are described having translucent sides to allow light from the light source 30 to pass through, the side walls the upper cylindrical shade 24 and lower cylindrical shade 26 can have frosted surfaces to allow for a frostier effect.

Additionally, the invention can also include having only the upper cylinder 24 being translucent and the lower cylinder 26 being opaque to control light emissions therethrough.

Also, the lower cylinder 26 can be translucent and the upper cylinder 24 being opaque to control light emissions that pass therethrough.

Additionally, the upper cylinder 24 and/or the lower cylinder 26 can be made with colored material, to further customized desired color effects of light passing through.

Also, the upper cylinder 24 and/or the lower cylinder 26 can be made to have ribs, a textured surface, a hammered surface or other pattern to the cylinder, to further customize the desired effects of light passing through.

Second Embodiment

FIG. 8A is a front view of a second preferred embodiment of a landscape light 100 with fixed top cover 110 over a light 130 and vertically adjustable side shades 140 on a frame 120.

FIG. 8B is a cross-sectional view of the landscape light 100 with fixed top cover 110 over a light 130 and vertically adjustable side shades 140 on a frame 120 of FIG. 8A along arrows 8B.

FIG. 8C is a perspective view of the cross-sectional view of FIG. 8B.

FIG. 9A is another perspective view of the cross-sectional view of FIG. 8C with one side shade 140 pulled down to a fully open position, and another side shade 140 fully raised to a closed position.

FIG. 9B is another side cross-sectional view of FIG. 9A with one side shade 140 in a fully open position and another side shade 140 partially raised. FIG. 10A is a front view of the frame without the side shades 140 on the frame 120 of FIGS. 8A-8C.

FIG. 10A is a front view of the frame 120 of FIGS. 8A-8C without the side shades 140 on the frame 120.

FIG. 10B is an upper front perspective view of the fame 120 without side shades 140 on the frame 120 of FIG. 10A.

FIG. 10C is a side cross-sectional view of the frame 120 without side shades 140 on the frame 120 of FIG. 10A along arrows 10C.

FIG. 10D is a perspective view of the side cross-sectional view of the frame 120 without side shades 140 on the fixture frame 120 of FIG. 10C.

FIG. 11A is an enlarged front view of one side shade 140 of FIGS. 8A-9B.

FIG. 11B is a perspective view of the side shade 140 of FIG. 11A.

FIG. 11C is a top view of the side shade 140 of FIG. 11A.

Referring to FIGS. 8A-11C, the landscape light 100 can include a top cover that can have a raised middle portion and downwardly sloping sides, or sides that will be used to reflect light emissions downward or both downward to outward to the sides. Under the light cover 110 can be a base 112 with support posts 114 that can support the raised middle portion of the light cover 110.

A frame 120 can have an upper end with a top rim 122 that can be attached under the base 112 of the top cover 110, the top rim 122 can include outwardly protruding tabs 123 that can attach into mateable slots (not shown) about a perimeter of the base 112.

Along outer sides of the frame 120 can be spaced apart side vertical frame member(s) 124 that have upper ends attached to the top rim 122 and bottom ends attached to the base 127 of the frame 120.

Along sides of the side vertical frame member(s) 124 can be vertical elongated channels 126 that face one another. The channels 126 can run along the side vertical frame member(s) 124 from below the top rim 122 to below the outwardly facing decorative louvers 128.

The side channels 126 in the side vertical frame member(s) 124, are to allow for side edges 145 of concave curved side shade(s) 140 to slide therein.

A user can grip a handle 142 to cause each shade 140 to slide upward to close an opening between spaced apart side vertical frame member(s) 124. Moving the handle 142 downward can open the opening between the spaced apart side vertical frame member(s) 124. The bottom 148 of the shade 140 can also pass behind the outwardly facing louvers 128.

In a preferred embodiment the frame 120 can have enough side vertical frame member(s) 124 to be able to support four vertically adjustable side shade(s) 140 between each pair of side vertical frame member 124.

Inside the frame 120 can be centrally located light source 130 above the base 127. The light source 130 can be an LED (light emitting diode), or another type of light source and the like. A preferred embodiment can include a dome shaped light source 130 that directs light emissions upward to be reflected under the sides of the top cover 110.

Underneath the base 127 of the frame 120 can be a downwardly extending stem 129 with exterior threads.

The upper end 152 of a post 150 can have a threaded interior socket portion for receiving the threaded stem 129 of the frame 120, where the threaded stem 129 can be screwed into the threaded interior socket 152 of the post 150. The lower end 158 of the post 150 can be inserted into the ground for supporting the light 100 in a vertical orientation. Alternatively, the lower end 158 can include a stake portion similar to the stake in the previous embodiment.

FIG. 12A is a side view the second preferred embodiment of the landscape light 100 with fixed top cover 110 over a light 130 and vertically adjustable side shades 140 on a frame 120 attached to a support post 150 of the preceding figures with all four side shades 140 fully open.

FIG. 12B is a top view of the landscape light 100 with fixed top cover 110 over a light 130 and vertically adjustable side shades 140 on a frame 120 attached to a support post 150 of FIG. 12A showing the outwardly directed light patterns.

FIG. 13A is a side view the second preferred embodiment of the landscape light 100 with fixed top cover 110 over a light 130 and vertically adjustable side shades 140 on a frame 120 attached to a support post 150 of the preceding figures with one of the side shades 120 fully open.

FIG. 13B is a top view of the landscape light 100 with fixed top cover 110 over a light 130 and vertically adjustable side shades 140 on a frame 120 attached to a support post 140 of FIG. 13A showing the outwardly directed light patterns.

FIG. 14A is a side view the second preferred embodiment of the landscape light 100 with fixed top cover 110 over a light 130 and vertically adjustable side shades 140 on a frame 120 attached to a support post 150 of the preceding figures with two opposing side shades 140 fully open and two other opposing side shades 140 fully closed.

FIG. 14B is a top view of the landscape light 100 with fixed top cover 110 over a light 130 and vertically adjustable side shades 140 on a frame 120 attached to a support post 150 of FIG. 14A showing the outwardly directed light patterns.

FIG. 15A is a side view the second preferred embodiment of the landscape light 100 with fixed top cover 110 over a light 130 and vertically adjustable side shades 140 on a frame 120 attached to a support post 150 of the preceding figures with rear facing side shades 140 fully open and front facing side shades 140 fully closed.

FIG. 15B is a top view of the landscape light 100 with fixed top cover 110 over a light 130 and vertically adjustable side shades 140 on a frame 120 attached to a support post 150 of FIG. 15A showing the outwardly directed light patterns.

FIG. 16A is a side view the second preferred embodiment of the landscape light 100 with fixed top cover 110 over a light 130 and vertically adjustable side shades 140 on a frame 120 attached to a support post 150 of the preceding figures with three of four adjacent side shades 140 fully open and the remaining side shade 140 fully closed.

FIG. 16B is a top view of the landscape light 100 with fixed top cover 110 over a light 130 and vertically adjustable side shades 140 on a frame attached to a support post 150 of FIG. 16A showing the outwardly directed light patterns.

Although the preferred embodiment shows concave curved side shades 140. The side shades can have other shapes such as planar rectangular panels, and the like.

While the preferred embodiments identify the light sources as LED (light emitting diodes), other light sources, such as bulbs and the like can be used.

Although the preferred embodiment shows 4 concave curved side shades 140, 2 or more side shades can be used to provide less or more options to effect the light pattern.

The terms pathway light and landscape light are used interchangeably throughout the application.

Although the application describes different embodiments of having vertically adjustable top covers, and raisable and lowerable side shades, the invention can include applications with the combination of both vertically adjustable top covers over the lights to control light patterns and with raiseable and lowerable side shades for the lights for adjusting light patterns emitting from the lights.

While the preferred embodiments are for use with pathway and landscape type lights, the invention can be used with other types of outdoor lights, such as wall mounted lantern lights and the like. Additionally, the invention can be used with indoor lights such as wall mounted lights and the like, and well as lantern type lights on floor supported stands, and the like.

Although specific advantages have been enumerated above, various embodiments may include some, none, or all of the enumerated advantages.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A pathway light, comprising:

a post configured to be inserted into the ground;

a fixture body having an upper end with an opening, and a lower end mounted to the post;

a light source within the fixture body, the light source for emitting light therefrom; and a vertically adjustable shade assembly with a top cover and a lower portion, the lower portion being vertically moveable into and out from the opening in the upper end of the fixture body, the vertically adjustable shade assembly having a down position for causing the light source to reflect downward about a perimeter of the post, the vertically adjustable shade assembly having a raised position for causing the light source to reflect and emit light patterns both sideways away from the fixture body and in a downward angled direction about a perimeter of the post, wherein the lower portion of the vertically adjustable shade assembly includes:

an upper cylinder with translucent sides having an upper diameter; and a lower cylinder with translucent sides having a lower diameter being smaller than the upper diameter; and a step between the upper cylinder and the lower cylinder, wherein the step forms a limiting stop for lowering the lower cylinder into the fixture body.

2. The pathway light of claim 1, further comprising:

a seal ring provided between the lower cylinder and the fixture body.

3. The pathway light of claim 1, wherein the top cover includes:

a raised mid portion and perimeter edges sloping downward from the raised middle portion.

4. The pathway light of claim 1, wherein the light source includes:

an LED (light emitting diode).

5. The pathway light of claim 1, wherein the lower portion of the vertically adjustable shade assembly includes:

translucent cylindrical sides for telescoping into and out of the opening in the upper end of the fixture body.

6. A pathway light comprising:

a post configured to be inserted into the ground, a fixture body having an open upper end and a lower end attached to the post;

a light source in the fixture body for emitting light upward through the open upper end of the fixture body; and a vertically adjustable shade assembly with a top cover mounted to a translucent cylinder, wherein the translucent cylinder is moveable into and out of the open upper end of the fixture body from an upward raised position to a downward lowered position.

7. The pathway light of claim 6, wherein the vertically adjustable shade assembly includes:

the upward raised position for emitting the light sideways from the fixture body and down about a perimeter of the post, the downward lowered position for allowing the light to be emitting downward about the perimeter of the post.

8. The pathway light of claim 6, wherein the top cover includes:

a raised mid portion and perimeter edges sloping downward from the raised middle portion.

9. The pathway light of claim 6, wherein the light source includes:

an LED (light emitting diode).

10. The pathway light of claim 6, wherein the post includes:

a ground engaging member for supporting the pathway light in a vertical orientation.

11. The pathway light of claim 6, wherein the translucent cylinder in the vertically adjustable shade assembly includes:

an upper cylinder with translucent sides having an upper diameter; and a lower cylinder with translucent sides having a lower diameter being smaller than the upper diameter.

12. The pathway light of claim 11, further comprising:

a seal ring between the lower cylinder and the fixture body.

13. The pathway light of claim 11, further comprising:

a step between the upper cylinder and the lower cylinder, wherein the step forms a limiting stop for lowering the lower cylinder into the fixture body.

14. A pathway light comprising:

a post configured to be inserted into the ground;

a fixture body having an open upper end and a lower end attached to the post;

a light source in the fixture body for emitting light upward through the open upper end of the fixture body; and a vertically adjustable shade assembly with a top cover mounted to a cylindrical base, wherein a portion of the cylindrical base is moveable into and out of the open upper end of the fixture body, the cylindrical base includes an upper cylinder with sides having an upper diameter, and a lower cylinder with sides having a lower diameter being smaller than the upper diameter, wherein at least one of the upper cylinder and the lower cylinder are translucent, wherein the portion of the cylindrical base is moveable into and out of the open upper end of the fixture body from a downward lowered position to an upward raised position, the upward raised position for emitting the light sideways from the fixture body and down about a perimeter of the post, the downward lowered position for allowing the light to be emitting downward about the perimeter of the post.

15. The pathway light of claim 14, wherein the upper cylinder is translucent.

16. The pathway light of claim 14, wherein the lower cylinder is translucent.

17. The pathway light of claim 14, wherein both the upper cylinder and the lower cylinder are translucent.

* * * * *